US011443586B2

(12) United States Patent
Shigeta

(10) Patent No.: US 11,443,586 B2
(45) Date of Patent: Sep. 13, 2022

(54) GAME MANAGEMENT SYSTEM

(71) Applicant: ANGEL GROUP CO., LTD., Shiga (JP)

(72) Inventor: Yasushi Shigeta, Shiga (JP)

(73) Assignee: ANGEL GROUP CO., LTD., Shiga (JP)

( * ) Notice: Subject to any disclaimer, the term of this patent is extended or adjusted under 35 U.S.C. 154(b) by 0 days.

(21) Appl. No.: 16/280,889

(22) Filed: Feb. 20, 2019

(65) Prior Publication Data

US 2019/0259238 A1 Aug. 22, 2019

(30) Foreign Application Priority Data

Feb. 19, 2018 (JP) ..... JP2018-027023

(51) Int. Cl.
*G07F 17/32* (2006.01)

(52) U.S. Cl.
CPC ..... *G07F 17/322* (2013.01); *G07F 17/3206* (2013.01); *G07F 17/3209* (2013.01); *G07F 17/3225* (2013.01); *G07F 17/3237* (2013.01); *G07F 17/3244* (2013.01); *G07F 17/3248* (2013.01); *G07F 17/3272* (2013.01); *G07F 17/3276* (2013.01); *G07F 17/3293* (2013.01)

(58) Field of Classification Search
None
See application file for complete search history.

(56) References Cited

U.S. PATENT DOCUMENTS

2008/0054568 A1 3/2008 Lutnick et al.
2010/0144428 A1* 6/2010 Fontaine ..... G07F 17/32 463/28
2011/0118007 A1* 5/2011 Gururajan ..... G07F 17/3234 463/25

(Continued)

FOREIGN PATENT DOCUMENTS

CN 102125756 A 7/2011
CN 106408785 A 2/2017

(Continued)

OTHER PUBLICATIONS

International Search Report dated Apr. 2, 2019 issued in corresponding PCT Application PCT/JP2019/005057.

(Continued)

*Primary Examiner* — Jason T Yen
(74) *Attorney, Agent, or Firm* — Norton Rose Fulbright US LLP

(57) ABSTRACT

A game management system for managing a casino game played on a gaming table of a casino facility includes: a camera which photographs a bet chip to obtain an image; a control device which specifies a bet amount for each player position on the gaming table on the basis of a position, a type, and the number of sheets of the chip in the image, a player number determination device which determines the number of players participating in a game on the gaming table, and a management control device which determines a recommended value of a minimum bet amount for each gaming table on the basis of information on a bet amount specified by the control device and information on the number of players determined by the player number determination device.

31 Claims, 27 Drawing Sheets

(56) References Cited

U.S. PATENT DOCUMENTS

| | | | | |
|---|---|---|---|---|
| 2011/0127722 | A1 | 6/2011 | Emori et al. | |
| 2012/0252564 | A1* | 10/2012 | Moore | G07F 17/3237 463/25 |
| 2012/0329537 | A1* | 12/2012 | Gururajan | G07F 17/322 463/1 |
| 2014/0094298 | A1 | 4/2014 | Lyons et al. | |
| 2015/0087417 | A1* | 3/2015 | George | G07F 17/3237 463/31 |
| 2015/0199872 | A1* | 7/2015 | George | G07F 17/3237 463/31 |
| 2017/0039807 | A1 | 2/2017 | Shigeta | |
| 2017/0178458 | A1 | 6/2017 | Morin et al. | |
| 2018/0089948 | A1* | 3/2018 | Olsen | G07F 17/3241 |
| 2018/0114406 | A1 | 4/2018 | Shigeta | |
| 2018/0247134 | A1* | 8/2018 | Bulzacki | A63F 3/00157 |
| 2019/0005767 | A1 | 1/2019 | Shigeta | |
| 2019/0188958 | A1 | 6/2019 | Shigeta | |
| 2020/0388102 | A1 | 12/2020 | Shigeta | |

FOREIGN PATENT DOCUMENTS

| | | | |
|---|---|---|---|
| CN | 107614071 | A | 1/2018 |
| CN | 107683494 | A | 2/2018 |
| JP | 2009219588 | A | 10/2009 |
| JP | 2014012192 | A | 1/2014 |
| JP | 2015-198935 | A | 11/2015 |
| JP | 2016045819 | A | 4/2016 |
| JP | 2019005565 | A | 1/2019 |
| WO | 2018025885 | A1 | 2/2018 |

OTHER PUBLICATIONS

European Search Report dated Apr. 4, 2019 issued in corresponding EP application 19157681.8.

Macao Office Action dated Jan. 8, 2020 issued in corresponding MO Application I/001603.

Chinese Office Action dated Feb. 9, 2021 issued in CN Application 201910121731.4.

Japanese Office Action dated Jul. 12, 2022 issued for JP Application No. 2019-023483.

* cited by examiner

Fig. 7

| ASSORTMENT | POSITIONAL RELATIONSHIP OF MARK | OUTPUT FROM SENSOR |
|---|---|---|
| 1 | BLANK<br>BLANK | OFF<br>OFF |
| 2 | BLANK<br>M | OFF<br>ON OFF |
| 3 | M<br>BLANK | ON OFF<br>OFF |
| 4 | M<br>M | ON OFF<br>ON OFF |

Fig. 9

| Table No. | Chip Count | | | | | | | | Total Amount |
|---|---|---|---|---|---|---|---|---|---|
| | $100,000 | $50,000 | $10,000 | $5,000 | $1,000 | $500 | $100 | $25 | |
| 1 | 4 | 10 | 37 | 43 | 62 | 70 | 85 | 26 | $1,591,150 |
| 2 | 5 | 11 | 35 | 20 | 89 | 67 | 82 | 23 | $1,631,275 |
| 3 | 5 | 12 | 36 | 36 | 56 | 66 | 52 | 36 | $1,735,100 |
| 4 | 2 | 7 | 49 | 45 | 78 | 65 | 61 | 31 | $1,382,375 |
| 5 | 3 | 15 | 36 | 18 | 52 | 63 | 70 | 25 | $1,591,125 |
| 6 | 4 | 10 | 44 | 41 | 80 | 60 | 80 | 38 | $1,663,950 |
| 7 | 6 | 5 | 34 | 26 | 51 | 66 | 77 | 42 | $1,412,750 |
| . | . | . | . | . | . | . | . | . | . |
| . | . | . | . | . | . | . | . | . | . |
| . | . | . | . | . | . | . | . | . | . |
| 73 | 36 | 24 | 50 | 20 | 12 | 27 | 31 | 18 | $5,429,050 |
| 74 | 47 | 20 | 28 | 21 | 46 | 21 | 40 | 12 | $6,145,800 |
| 75 | 4 | 5 | 30 | 20 | 66 | 68 | 80 | 27 | $1,158,675 |
| Total | 311 | 750 | 2904 | 2454 | 5014 | 4896 | 5432 | 2368 | $117,974,400 |

Fig. 10

Table 1

| Game No. | $100,000 | $50,000 | $10,000 | $5,000 | $1,000 | $500 | $100 | $25 | Total Amount |
|---|---|---|---|---|---|---|---|---|---|
| 1 | 0 | 0 | 0 | 0 | 1 | 1 | 3 | 1 | $1,825 |
| 2 | 0 | 0 | 1 | 0 | 0 | 2 | 4 | 0 | $11,400 |
| 3 | 0 | 0 | 0 | 2 | 3 | 3 | 2 | 0 | $14,700 |
| . | . | . | . | . | . | . | . | . | . |
| . | . | . | . | . | . | . | . | . | . |
| . | . | . | . | . | . | . | . | . | . |
| 79 | 0 | 0 | 2 | 0 | 2 | 0 | 2 | 1 | $22,225 |
| 80 | 0 | 0 | 0 | 1 | 0 | 1 | 2 | 0 | $5,700 |
| Total | 4 | 10 | 37 | 43 | 62 | 70 | 85 | 26 | $1,591,150 |

Fig. 11

| Table No. | Total Bet Amount | Gross Profit | Profit Ratio |
|---|---|---|---|
| 1 | $1,700,200 | $42,505 | 2.5% |
| 2 | $1,460,400 | $58,416 | 4.0% |
| 3 | $1,050,500 | -$21,010 | -2.0% |
| 4 | $1,650,700 | $39,617 | 2.4% |
| 5 | $968,000 | $32,912 | 3.4% |
| 6 | $1,104,200 | $16,563 | 1.5% |
| 7 | $1,458,500 | $90,427 | 6.2% |
| . | . | . | . |
| . | . | . | . |
| . | . | . | . |
| 75 | $1,755,425 | $43,886 | 2.5% |
| Total | $100,633,929 | $3,019,018 | 3.0% |

Fig. 16A

| | PLAYER 1 | PLAYER 2 | PLAYER 3 | PLAYER 4 |
|---|---|---|---|---|
| 1 | $1,000 | $3,000 | $2,000 | $1,000 |
| 2 | $1,200 | $3,000 | $1,500 | $1,500 |
| 3 | $2,000 | $2,000 | $1,800 | $1,000 |
| 4 | $1,000 | $3,500 | $2,300 | $1,300 |
| 5 | $1,500 | $2,300 | $1,800 | $1,000 |
| | ↓ | ↓ | ↓ | ↓ |
| LOWEST AMOUNT | $1,000 | $2,000 | $1,500 | $1,000 |
| | LOW AMOUNT | HIGH AMOUNT | HIGH AMOUNT | LOW AMOUNT |

Fig. 16B

| | PLAYER 1 | PLAYER 2 | PLAYER 3 | PLAYER 4 |
|---|---|---|---|---|
| 1 | $1,000 | $1,500 | $2,000 | $1,300 |
| 2 | $1,200 | $2,000 | $1,000 | $1,500 |
| 3 | $2,000 | $2,000 | $1,500 | $1,100 |
| 4 | $1,000 | $3,000 | $1,300 | $1,300 |
| 5 | $1,500 | $1,500 | $1,800 | $1,200 |
| | ↓ | ↓ | ↓ | ↓ |
| LOWEST AMOUNT | $1,000 | $1,500 | $1,000 | $1,100 |
| | LOW AMOUNT | HIGH AMOUNT | LOW AMOUNT | LOW AMOUNT |

GAME MANAGEMENT SYSTEM

CROSS REFERENCE TO RELATED APPLICATION

This application claims priority under 35 U.S.C. § 119(a) to JP Application No. 2018-27023 filed Feb. 19, 2018, the entire contents of which are hereby incorporated by reference.

FIELD

The present disclosure relates to a game management system for managing a casino game played on a gaming table of a casino facility (game hall).

BACKGROUND AND SUMMARY

A plurality of gaming tables are installed in a casino facility, and a casino operator wants to increase sales of the whole casino facility, that is, a total bet amount of all players. A plurality of gaming tables are closed or opened according to the number of players. In a closed gaming table, a game is not played and a player cannot play a game. A dealer is placed in an opened gaming table, a game is played, and a player can play a game.

In each gaming table, a minimum bet amount is set. The minimum bet amount is the lowest bet amount on the gaming table, and in a single game, a player should bet an amount equal to or more than the minimum bet amount set for the gaming table. The minimum bet amount is set for each gaming table.

In each gaming table, the number of players playing a game is not fixed, a game may be performed by a small number of players, and may be performed by a large number of players. Conventionally, as the number of tables played by a large number of players increases, the casino operators understand the increased number of tables to execute operations by, for example, opening a closed gaming table.

In a certain gaming table, if a player (high betting player) playing a game with a bet amount sufficiently more than the minimum bet amount and a player (low betting player) playing a game with the minimum bet amount or a slightly higher bet amount are mixed, the sales of the whole casino facility are likely to be kept low.

FIG. 19 is a diagram for describing such a situation. As shown in an upper part of FIG. 19, it is assumed that the minimum bet amount is set at 1,000 dollars in a certain play table, and one high betting player with a bet amount of about 10,000 dollars is playing a game. At this time, it is assumed that an average time required for one game is 60 seconds, and an average sales per hour are 600,000 dollars.

If three low betting players with a bet amount of about 1,000 dollars are added to the gaming table, the total bet amount for the gaming table will increase to about 13,000 dollars, but an average time required for one game will also increase with the increase in the number of players. Assuming that a playtime increases by 10 seconds whenever the number of players increases by one, the approximate time required for one game becomes 90 seconds if the number of players is four. As a result, the sales per hour are likely to decrease from about 600,000 dollars to about 520,000 dollars. In this way, since the high betting player and the low betting player are mixed in the same gaming table, even if the number of players increases, the sales of the casino operator decrease.

FIGS. 20A and 20B are diagrams for describing another example. As shown in FIG. 20A, the minimum bet amount for one of two gaming tables is set to 10,000 dollars and the minimum bet amount for the other is set to 1,000 dollars. The average time when it takes a high betting player to play one game on a gaming table is 70 seconds, and the sales per hour are about 1,030,000 dollars. On the other hand, the average time when it takes a low betting player to play one game on a gaming table is 90 seconds, and the sales per hour are about 160,000 dollars. Therefore, the total sales per hour of the two gaming tables are about 1,190,000 dollars.

In the example of FIG. 20B, the two high betting players of FIG. 20A are dispersed in different gaming tables. That is, there are two gaming tables in which the minimum bet amount is set to 1,000 dollars, and in any of the two gaming tables, one high betting player with a bet amount of about 10,000 dollars and one low betting player with a bet amount of about 1,000 dollars are playing a game. At this time, the average time required for one game on each gaming table is 80 seconds, the sales per hour are about 540,000 dollars, and the total sales per hour in the two gaming tables are about 1,080,000 dollars.

In this way, if the high betting player is dispersed in a plurality of gaming tables and the high betting player and the low betting player is mixed in each gaming table, the sales of the casino operator are likely to decrease (in the case of FIGS. 20A and 20B, from 1,190,000 dollars to 1,080,000 dollars).

As in the above example, since the high betting player and the low betting player are mixed in the gaming table without properly setting the minimum bet amount, there is a problem in that not only the sales of the casino operator decrease, but also the time when it takes the high betting player to play one game is long, which leads to a problem that it is difficult to comfortably play a game.

An object of the present disclosure is to improve sales of a casino operator by determining an appropriate minimum bet amount for a gaming table in a game management system for managing a casino game played on a gaming table of a casino facility, thereby enabling an operation of the casino facility where a high betting player can comfortably play a game.

A game management system according to one aspect of the present invention is a game management system for managing a casino game played on a gaming table of a casino facility, in which the game management system includes: an information processing device which specifies a bet amount at each player position on a gaming table on the basis of positions, types, and number of bet gaming tokens; a player number determination device which determines the number of players participating in a game on the gaming table; and a management control device which determines a recommended value of the minimum bet amount for each gaming table on the basis of information on the bet amount specified by the information processing device and information on the number of players determined by the player number determination device.

With this configuration, the recommended value of the minimum bet amount is determined on the basis of the bet amount at each player position on the gaming table and the number of players, so that it is possible to increase the sales of the casino operator and enable the operation of the casino facility where the high betting player can comfortably play a game. The information processing device may determine the position, the type and the number of gaming tokens on the basis of the image obtained by photographing the bet gaming token or the position, the type, and the number of gaming tokens by other devices.

In the above game management system, the management control device may be configured to be capable of determining transition of the bet amount in the plurality of games at each player position.

The game management system may further include a game result determination device capable of determining a result of a game, in which the management control device may be configured to be capable of determining a win and loss and an income and expenditure at each player position on the basis of the information on the bet amount specified by the information processing device and information on the result of the game determined by the game result determination device.

In the game management system, the management control device may determine the recommended value of the minimum bet amount for each gaming table on the basis of the information on the transition of the bet amounts at each player position or the transition of the income and expenditure at each player position.

With this configuration, the recommended value of the minimum bet amount can be determined on the basis of the transition of the bet amount or and the income and expenditure. For example, the relatively small amount may be determined as the recommended value of the minimum bet amount when the bet amount of many players tends to decrease in a certain table. As another example, for example, when the income and expenditure of many players tends to increase in a certain table, the relatively large amount may be determined as the recommended value of the minimum bet amount.

In the game management system, the management control device may include a function of determining the congestion degree of each area within the casino facility on the basis of the information on the number of players determined by the player number determination device, and determining the recommended value of the minimum bet amounts for each gaming table of each area depending on the congestion degree.

With this configuration, it is possible to determine the recommended value of the minimum bet amount so that the player is guided to a specific area on the basis of the congestion degree in the casino facility.

In the game management system, the management control device may include a function of determining the recommended value of the minimum bet amount divided into a plurality of stages on the basis of information on the number of players determined by the player number determination device and information on the lowest amount among the bet amounts at each player position or information on an average bet amount.

With this configuration, when the lowest bet amount or the average bet amount is high, it is possible to determine the recommended value of the high minimum bet amount.

In the game management system, the management control device may include a function of increasing the recommended value of the minimum bet amount when the players betting an amount equal to or more than a predetermined ratio with respect to the minimum bet amount for the gaming table is a predetermined ratio or more.

With this configuration, it is possible to exclude the low betting player by increasing the recommended value of the minimum bet amount when the ratio of the high betting player is equal to or larger than the predetermined value.

In the game management system, the management control device may include a function of determining the number of gaming tables that is opened in the casino facility, and determining the recommended number of gaming tables to be opened in each area depending on the congestion degree.

With this configuration, it is possible to open the gaming table in an appropriate area depending on the congestion degree so that the sales of the whole casino facility increase.

In the game management system, the management control device may include a function of recording the transition of the congestion degree in each area, and determining the recommended number of gaming tables to be opened in each area on the basis of the recorded information on the transition.

With this configuration, it is possible to predict the congestion degree on the basis of the transition of the congestion degree to open the gaming table.

The game management system may further include a player identification unit which identifies a player participating in a game on the gaming table, and the management control device may include a function of associating information on each player identified by the player identification unit with bet amounts at each player position identified by the information processing device and storing the associated data in a database and a function of determining the recommended number of gaming tables to be opened in each area on the basis of information on the past bet tendency of each of the players.

With this configuration, it is possible to determine the recommended number of gaming tables to be opened in each area on the basis of the bet tendency of each player.

In the game management system, the management control device may determine the minimum bet amount of a newly opened gaming table on the basis of the minimum bet amount for the gaming table around the newly opened gaming table.

With this configuration, when a new gaming table is opened, the minimum bet amount for the gaming table can be determined to be the same amount as or a different amount from the minimum bet amount for the gaming table around the newly opened gaming table.

In the game management system, the management control device may determine the minimum bet amount of a newly opened gaming table on the basis of the bet amount specified by the information processing device for the gaming table around the newly opened gaming table.

With this configuration, when the new gaming table is opened, the minimum bet amount for the gaming table can be determined depending on the actual bet amount for the gaming table around the newly opened gaming table.

In the game management system, the management control device may manage the number of dealers and determine whether or not to newly open a gaming table on the basis of the number of dealers under management.

With this configuration, it is possible to open the new gaming table on the basis of the number of dealers.

In the game management system, the management control device may change the minimum bet amount for the gaming table around the newly opened gaming table as a gaming table is newly opened.

With this configuration, it is possible to urge a player to move from the already opened gaming table to the newly opened gaming table.

In the game management system, the management control device may determine the recommended value of the minimum bet amount for each gaming table so as to increase a profit ratio to sales.

With this configuration, it is possible to increase the profit ratio to sales by setting the minimum bet amount according to the recommended value. The management control device may determine the recommended value of the minimum bet amount for each gaming table so as to maximize the profit ratio to sales.

In the game management system, the management control device may determine the recommended value of the minimum bet amounts for each gaming table so as to increase the number of games per unit time or an average value of the total bet amounts per game.

With this configuration, it is possible to increase the number of games per unit time or the average value of total bet amount per game by determining the minimum bet amount according to the recommended value. The management control device may determine the recommended value of the minimum bet amount for each gaming table so as to maximize the number of games per unit time or the average value of the total bet amounts per game.

In the game management system, the management control device may determine the total bet amount of each player for each game, and/or each predetermined time or period, for each of the gaming tables, and determine the recommended value of the minimum bet amount for each gaming table.

With this configuration, it is possible to determine the recommended value of the appropriate minimum bet amount for each gaming table.

In the game management system, the management control device may manage the plurality of gaming tables, determine the total bet amount of each player for each game and/or each predetermined time or period in units of the plurality of gaming tables, and determine different recommended value of the minimum bet amount for each of the plurality of gaming tables.

With this configuration, it is possible to determine the recommended value of the appropriate minimum bet amount by considering the plurality of gaming tables overall.

In the game management system, the management control device may manage the plurality of gaming tables, determine the total bet amount of each player for each game and/or each predetermined time or period in units of the plurality of gaming tables, and determine the recommended value of the minimum bet amount for the newly opened gaming table.

With this configuration, it is possible to determine the recommended value of the newly opened minimum bet amount by considering the plurality of gaming tables overall.

In the game management system, the management control device may manage the plurality of gaming tables, determine information on at least one item of the number of the players, the bet amount, or the concentration or dispersion of the number of players in the units of the plurality of gaming tables, and determine the recommended value of the minimum bet amount for each gaming table on the basis of the information.

With this configuration, it is possible to determine the recommended value of the appropriate minimum bet amount for each gaming table on the basis of the number of players, the bet amount, the concentration or dispersion of the number of players on the plurality of gaming tables, and the like in the plurality of gaming tables.

The foregoing and other objects, features, aspects and advantages of the exemplary embodiments will become more apparent from the following detailed description of the exemplary embodiments when taken in conjunction with the accompanying drawings.

BRIEF DESCRIPTION OF THE DRAWINGS

FIG. 7 is a diagram showing a relationship between output waveforms of sensors and marks in the card distribution device in the first embodiment of the present invention;

FIG. 9 is a diagram showing an example of a table showing sales (total bet amount) for each gaming table according to the first embodiment of the present invention;

FIG. 10 is a diagram showing an example of a table showing sales for each game in each gaming table according to the first embodiment of the present invention;

FIG. 11 is a diagram showing an example of a table showing a total bet amount, a profit (gross profit), and a profit ratio for each gaming table according to the first embodiment of the present invention;

FIG. 16A is a diagram showing an example of determining a recommended value of a minimum bet amount according to an actual bet amount;

FIG. 16B is a diagram showing an example of determining a recommended value of a minimum bet amount according to the actual bet amount;

DETAILED DESCRIPTION OF NON-LIMITING EXAMPLE EMBODIMENTS

First Embodiment

Figure 1:
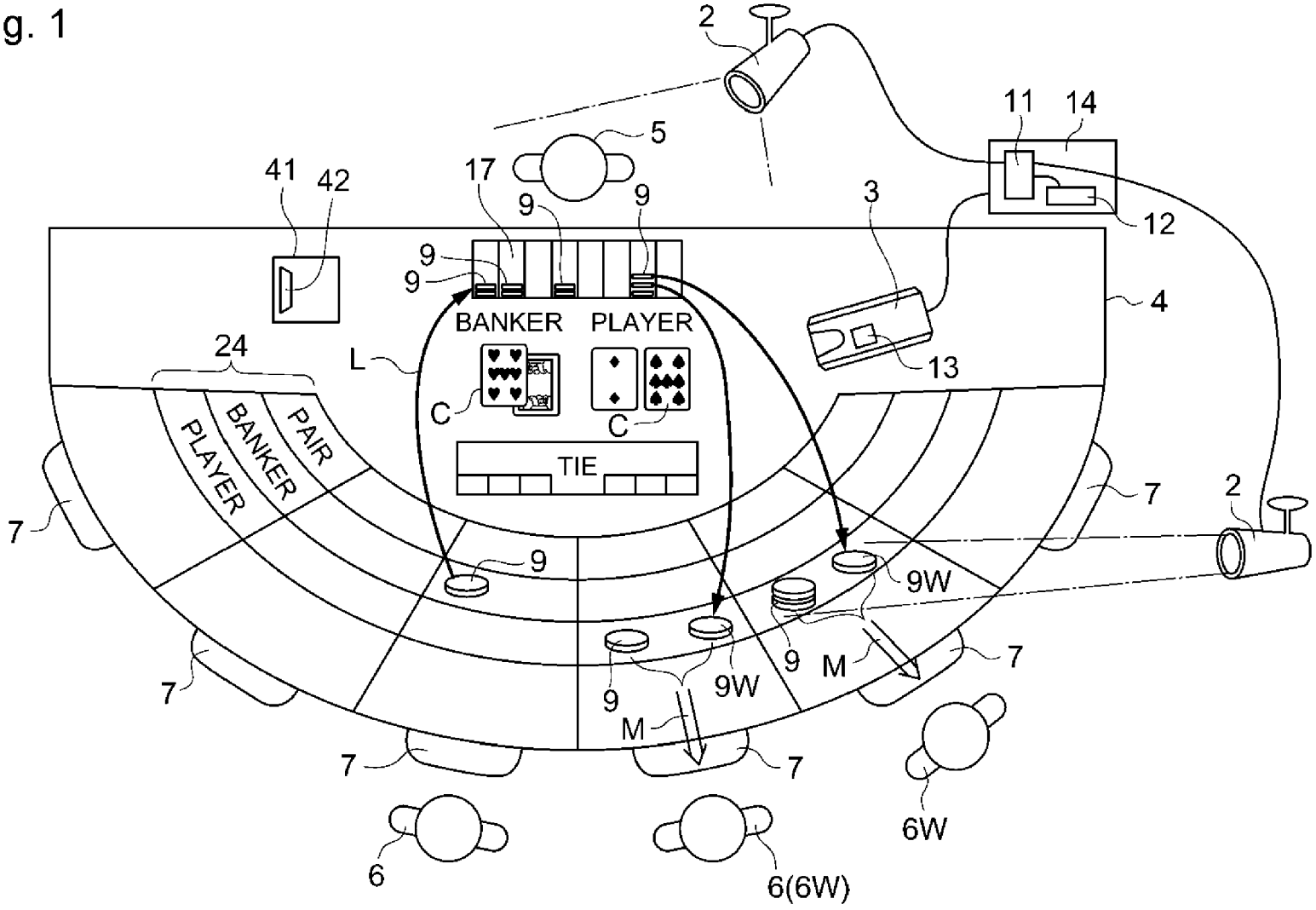
FIG. 1 is a diagram schematically showing the entire fraud detection system in a game hall having a plurality of gaming tables according to a first embodiment of the present invention.

Real "sales" of a casino manager in casino facilities (a casino) are the total amount of chips (gaming tokens) bet by a player. In addition, an amount obtained by subtracting a paid amount from the sales is a profit (a gross profit) of the casino manager. However, in the current casino, the sales or the profit are not capable of being managed. In addition, a transition of the sales or the profit for each table or each pit is not capable of being recognized in detail.

Therefore, an object of this embodiment is to recognize the sales or the profit in all of the casinos, or the profit or the profit for each table or each pit.

In order to attain the object described above, one aspect of this embodiment is a game management system managing a casino game performed in a plurality of tables in casino facilities, the system including: a camera obtaining an image by capturing bet gaming tokens; an information processing device specifying a betting amount on the basis of the type and the number of gaming tokens in the image by specifying a betting target on the basis of a position of the gaming token in the image; a game result determination device determining a game result of the casino game; a calculation device calculating a profit of a casino manager for each table and each game of the plurality of tables, on the basis of the betting target, the betting amount, and the game result; and a recording apparatus recording the profit.

The game result determination device may be an electronic shoe including a containing portion containing playing cards, an extraction mechanism for extracting the playing cards one by one from the containing portion, a detection unit detecting contents of the playing cards extracted by the extraction mechanism, and a determination unit determining a game result of a baccarat game according to a rule of the baccarat game, on the basis of the contents of the playing cards detected by the detection unit.

In addition, another aspect of this embodiment is a game management system managing a casino game performed in casino facilities, the system including: a betting detection section detecting betting contents including a betting target and a betting amount of the casino game; a game result determination section determining a game result of the casino game; and a calculation section calculating a profit of a casino manager on the basis of the betting contents and the game result.

The betting detection section may include a capturing section obtaining an image by capturing the casino game, and an information processing section specifying the betting contents on the basis of the image.

The information processing section may specify the betting contents on the basis of the position, the type, and the number of gaming tokens in the image.

The information processing section may specify the betting contents on the basis of the image, according to image recognition using a machine learning model.

The casino game may be a game using playing cards, and the game result determination section may include, an electronic shoe including a containing portion containing the playing cards, an extraction mechanism for extracting the playing cards one by one from the containing portion, and a detection unit detecting contents of the playing cards extracted by the extraction mechanism, and a determination section determining a game result of the casino game according to a rule of the casino game, on the basis of the contents of the playing cards detected by the detection unit.

The game management system may further include a dealer amount detection section detecting a total amount of gaming tokens of a dealer, and the calculation section may further calculate the profit, on the basis of the total amount.

An RF tag storing information of being capable of specifying at least a value of the gaming token may be built in the gaming token, and the dealer amount detection section may include an RF reader reading out the RF tag.

The betting detection section may detect the betting contents for each game, the game result determination section may determine the game result for each game, and the calculation section may calculate a profit for each game on the basis of the betting contents and the game result of the same game.

The game management system may further include a table creation section creating a table indicating the profit for each game.

The casino facilities may include a plurality of tables in which the casino game is performed, the betting detection section and the game result determination section may be disposed on each table, and the calculation section may calculate the profit for each table, with respect to the plurality of tables.

The game management system may further include a table creation section creating a table indicating the profit for each table.

The calculation section may further calculate a total betting amount on the basis of the betting contents.

The calculation section may further calculate a profit rate on the basis of the profit and the total betting amount.

The game management system may further include an alarming section generating an alarm with respect to the profit rate of less than or equal to a predetermined threshold value.

The game management system may further include an alarming section generating an alarm with respect to the profit rate of greater than or equal to a predetermined threshold value.

Still another aspect of this embodiment is a game management system managing a casino game performed in a plurality of tables in casino facilities, the system including: a camera obtaining an image by capturing bet gaming tokens, an information processing device specifying a betting amount on the basis of the type and the number of gaming tokens in the image; a calculation device calculating a total betting amount for each table with respect to the plurality of tables; and a recording apparatus recording the total betting amount for each table.

Still another aspect of this embodiment is a game management system managing a casino game performed in a table of casino facilities, the system including: a camera obtaining an image by capturing bet gaming tokens; an information processing device specifying a betting amount on the basis of the type and the number of gaming tokens in the image; a calculation device calculating a total betting amount for each game; and a recording apparatus recording a transition of the total betting amount for each game.

The game management system of this embodiment is capable of recognizing the sales (the total betting amount) or the profit for each of all or a part (the table) of the casino facilities according to the configuration described above.

Hereinafter, a game management system of this embodiment will be described. FIG. 1 is a diagram illustrating the overview of the system. The game management system in a casino having a plurality of gaming tables 4 is configured to include a game recording apparatus 11 which records a progress of a game played on the gaming table 4 including a player 6 and a dealer 5 as an image through a plurality of cameras 2, an image analyzing apparatus 12 which performs image analysis on the recorded image of the progress of the game, and a card distribution device 3 which has a function of determining a win or lose result of each game in the gaming table 4 and displaying the win or lose result. The card distribution device 3 is a so-called electronic shoe used by the skilled in the art and has a structure where a game rule is programmed in advance and win or lose of the game can be determined by reading information of the cards C distributed. For example, in a baccarat game, banker win, player win, or tie is basically determined by a rank of two or three cards, and a determination result (win or lose result) is displayed by a result display lamp 13.

The game management system is configured to further include a control device 14 which compares the actual rank of the cards according to the result of the image analysis by the image analyzing apparatus 12 and the win or lose result determined by the card distribution device 3 to detect fraud (for example, mismatch between a sum of ranks of distributed cards and a win or lose result) performed in the gaming table 4. The card distribution device 3 has a structure capable of reading rank (A, 2 to 10, J, Q, K) and suit (heart, spade, or the like) of the card C manually distributed by the dealer 5. The control device 14 has a structure capable of determining match or mismatch by checking information on rank and suit obtained from the image (captured by using the camera 2) of each card distributed in the gaming table 4 by the image analyzing apparatus 12 (using artificial intelligence) and information on rank and suit read by the card distribution device 3. In this game management system, each of the image analyzing apparatus 12 and the control device 14 has a structure including a computer configured with an integrated or plural components, a program, and a memory in a complex manner.

Figure 4:
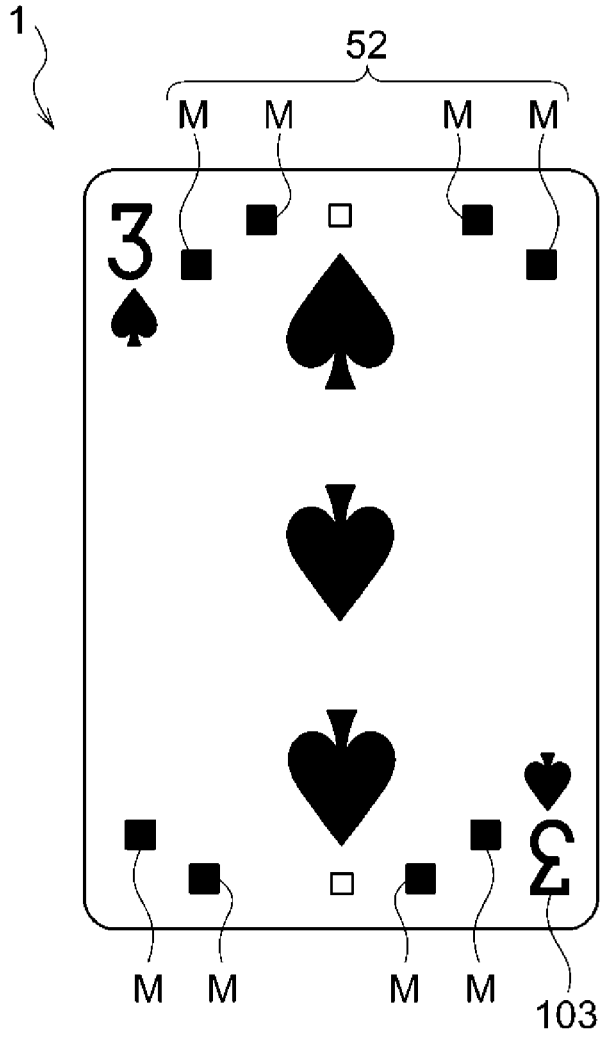
FIG. 4 is a diagram showing an example of a card in the first embodiment of the present invention.

Each of the image analyzing apparatus 12 and the control device 14 has an artificial intelligence utilizing type structure or a deep learning structure where, with respect to even a card C which is distributed in the gaming table 4 and is folded or stained by the player 6, information on rank of the card can be obtained. As illustrated in FIG. 4, there occurs a situation where the stained card C is difficult to distinguish clover from spade lt. Even in this case, suit determination can be performed by image analysis and determination using an artificial intelligence utilizing type computer or control system and a deep learning (structure) technique. In addition, although the cards are slanted by "card squeegee" frequently performed by players in a baccarat game or the like, the suits or ranks of the cards before deformation can be recognized by using self-learning or the like of a large number of images in a modified example by artificial intelligence utilizing type computer or control system and a deep learning (structure) technique. Since the artificial intelligence utilizing type computer or control system and a deep learning (structure) technique are well-known and available by the skilled in the art, the description thereof is omitted.

Figure 2A:
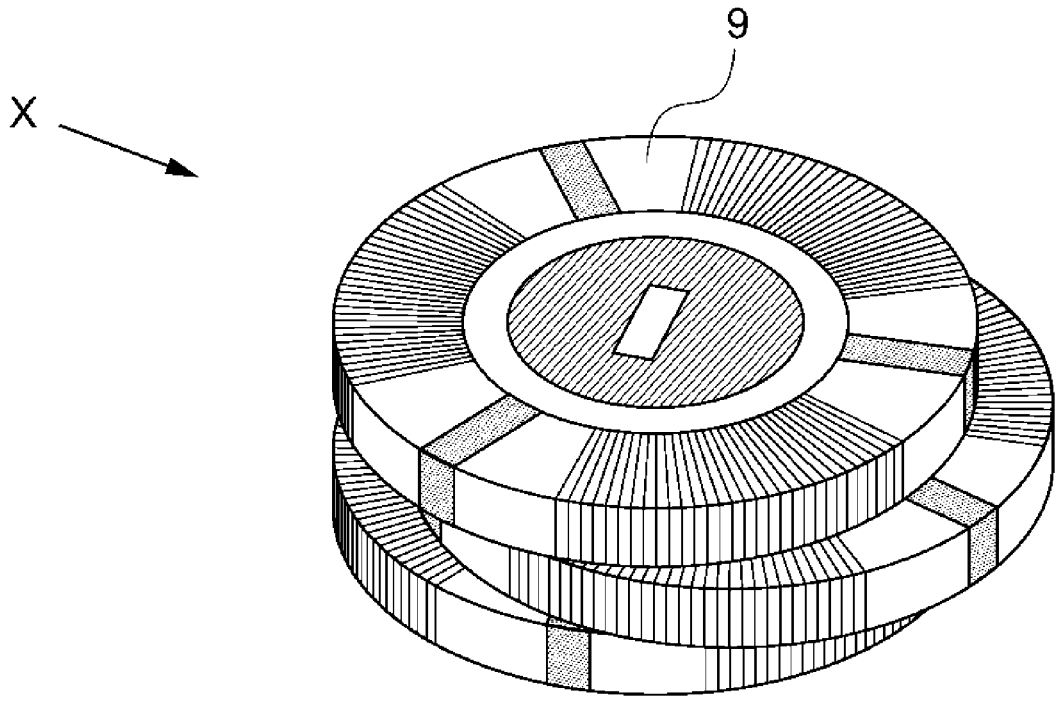
FIG. 2A is a perspective view of a chip showing an example of different overlapping states of understood chips in the first embodiment of the present invention.
Figure 2B:
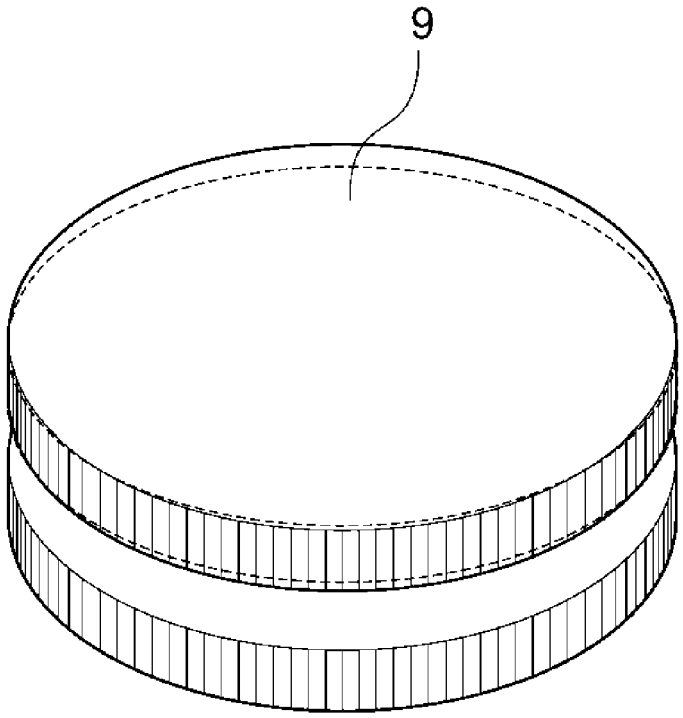
FIG. 2B is a perspective view of the chip showing the example of different overlapping states of the understood chips in the first embodiment of the present invention.
Figure 3:
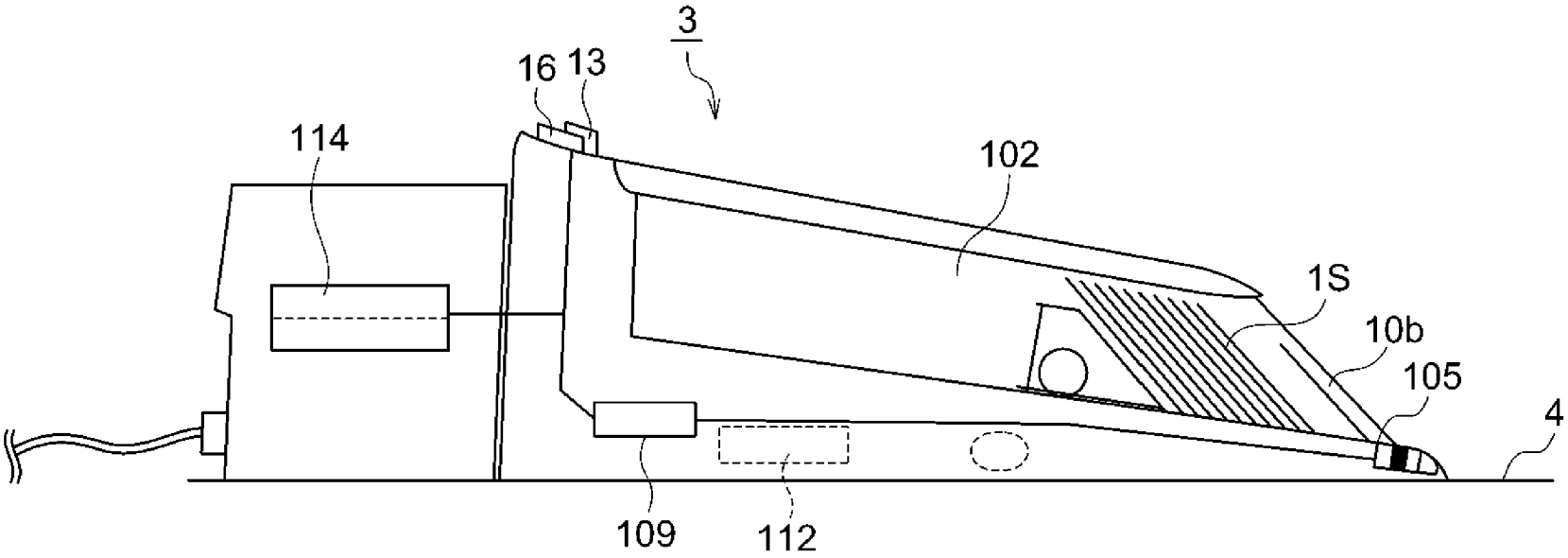
FIG. 3 is a side cross-sectional view of a card distribution device in the first embodiment of the present invention.

The control device 14 having an artificial intelligence utilizing type structure or a deep learning structure can recognize, through the camera 2 and the image analyzing apparatus 12, the position (player, banker, or pair) of the betting area 8 on which the player 6 wagers the chip 9 and the types (different amount values are designated to different colors of the chips 9) and the number of the wagered chips 9. In many case, the chips 9 are not aligned and stacked in the vertical direction, but as illustrated in FIG. 2A, the chips are deviated and overlapped. In this case, it is assumed that, when the camera 2 is disposed in a direction of an arrow X illustrated in FIG. 2A (or when the direction of the chip 9 becomes a blind spot direction relatively), as illustrated in FIG. 2B, the chip 9 is not seen (in a blind spot). In an artificial intelligence utilizing type computer or control system and a deep learning (structure) technique, by using a self-learning function or the like, concealing or the like (including concealing of a portion of one chip and concealing of the entire chip) of the chip 9 caused by the blind spot is recognized, so that the number of chips or the like can be accurately recognized. In this manner, since which position (player, banker, or pair) of the betting area 8 the chips 9 are wagered on, types of wagered chips 9 (different amount values are designated to different colors of the chips 9), and the number of chips can be recognized, the control device 14 determines by image analysis of a progress of the game through the image analyzing apparatus 12 whether or not collection (indicated by an arrow L) of lost chips wagered by the players 6 and redemption (9W) for wined chips to the winning player 6W are correctly performed in accordance with a win or lose result of the game determined by the card distribution device 3 for each game.

The control device 14 is capable of performing analysis and recognition of the total amount of the chips 9 in the chip tray 17 of the dealer 5 of the gaming table 4 by using the image analyzing apparatus 12 and is capable of performing comparison calculation according to the win or lose result of the game as to whether or not the total amount of the chips 9 in the chip tray 17 is increased or decreased according to the amount of the collection of the lost chips 9 wagered by the players 6 and the redemption 9W of the winning chips of the winning player 6W after the end of the game and the settlement. Although the total amount of the chips 9 in the chip tray 17 are always checked by means of RFID or the like, whether or not the increased or decreased amount is correct is performed by the control device 14 allowing the image analyzing apparatus 12 to perform image analysis of the progress of the game. An artificial intelligence utilizing type structure or a deep learning structure is used for these configurations.

In this example, since fraud or error is detected based on the information of the win or lose result of the game, information as to what position (player, banker, or pair) of the betting area 8 how many and what type of the chips 9 are wagered on, and the increased/decreased amount of the chips 9 in the chip tray 17 after the collection of the lost chips and the redemption for the winning chips 9, fraud or error can be detected although the recognition of the movement of the chips 9 after the end of the game, that is, the movement of the wagered chips 9 toward the player side or the movement toward the dealer side is not performed.

Herein, for example, in the baccarat, the win or lose result of the game can be determined in accordance with the rule of the baccarat by reading the rank of a card C fed out in the game in the card distribution device 3. In addition, the win or lose result of the game can be determined by capturing an image of the gaming table 4 by using the camera 2, analyzing the image by using the image analyzing apparatus 12, and matching the analysis result with the game rule by using the control device 14. In this case, the camera 2, the image analyzing apparatus 12, and the control device 14 constitute a win/lose result determining apparatus. Information on the players at each play position 7 and information as to what position (player, banker, or pair) of the betting area 8 how many and what type of the chips 9 are wagered on can be obtained by capturing an image of the chips 9 placed on the betting area 8 by using the camera 2 and analyzing the image at each play position 7 by using the image analyzing apparatus 12.

In addition, the increased/decreased amount of the chips 9 in the chip tray 17 before and after the collection of the lost chips 9 and the redemption for the winning chips 9 can be calculated by comparing total amount of the chips 9 in the chip tray 17 before the collection of the lost chips 9 and the redemption for the winning chips 9 and the total amount of the chips 9 in the chip tray 17 after the collection of the lost chips 9 and the redemption for the winning chips 9. The total amount of the chips 9 in the chip tray 17 before the collection of the lost chips 9 and the redemption for the winning chips 9 and the total amount of the chips 9 in the chip tray 17 after the collection of the lost chips 9 and the redemption for the winning chips 9 can be detected by capturing an image of the chip tray 17 containing the chips 9 by using the camera 2 and analyzing the image by using the image analyzing apparatus 12. In addition, the total amount of the chips 9 contained in the chip tray 17 may be detected by burying RFIDs representing the amount is in the chips 9 and providing an RFID reader to the chip tray 17.

For example, the total amount of the chips 9 in the chip tray 17 before the start of the game is denoted by Bb, and the total amount of the chips 9 in the chip tray 17 after the end of the game and the end of the collection of the lost chips and the redemption of the winning chip is denoted by Ba. In addition, in the game, the total amount of the entire play positions 7 in the player area where the chips 9 are wagered is denoted by bp, the total amount of the entire play positions 7 in the banker area where the chips 9 are wagered is denoted by bb, and the total amount of the entire play positions 7 in the tie area where the chips 9 are wagered is denoted by bt. For example, in the case where the win or lose result of the game is banker win, Ba-Bb=bp−bb+bt needs to be satisfied. Alternatively, the total amount Ba of the chips 9 in the chip tray 17 after the end of the game needs to be (Bb+bp−bb+bt). In the case where the above condition is not satisfied, it may be determined that fraud or mistake occurs in the collection of the chips or the redemption for the chips.

Hereinafter, an embodiment of the card distribution device 3 used in a table game system according to the invention will be described with reference to FIGS. 3 to 7. The card distribution device 3 is configured to include a card containing portion 102 which contains a plurality of shuffle playing cards 1s, a card guiding portion 105 which guides the shuffle playing card 1 when the dealer 5 or the like manually extracts the shuffle playing card 1 one by one from the card containing portion 102 toward the gaming table 4, an opening portion 106 for taking the card 1 guided from the card guiding portion 105, a card detecting unit (card detecting sensors 22 and 23) which detects that the shuffle playing card 1 is extracted when the shuffle playing card 1 is extracted, a card reading unit 108 which reads information representing at least the number (rank) of the shuffle playing card 1, a control unit 109 which determines the win or lose of the card game based on the numbers (ranks) of the shuffle playing cards 1 sequentially read by the card reading unit 108, a result display lamp 13 which displays the win or lose result determined by the control unit 109, a distribution restricting device 30 which is provided to the opening portion 106 and restricts entering and exiting of the card 1 from the card containing portion 102, and a management control unit 114 having functions equivalent to the control device 14, and these components are integrated. The card distribution device has a function where, in the case where error or fraud of the dealer in the game is detected by the control device 14, the further extraction of the card from the card distribution device 3 is stopped after the time of the detection or at a predetermined timing.

Figure 5:
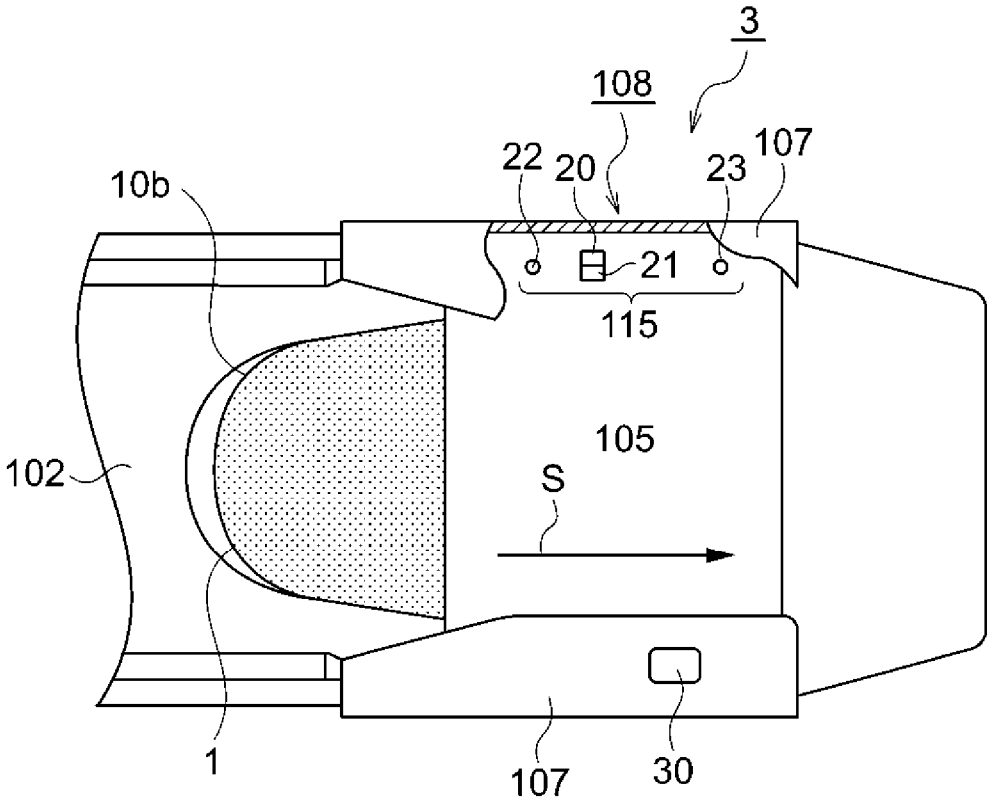
FIG. 5 is a plan view showing a main portion of a state in which a card guide unit of the card distribution device in the first embodiment of the present invention is partially broken.
Figure 6A:
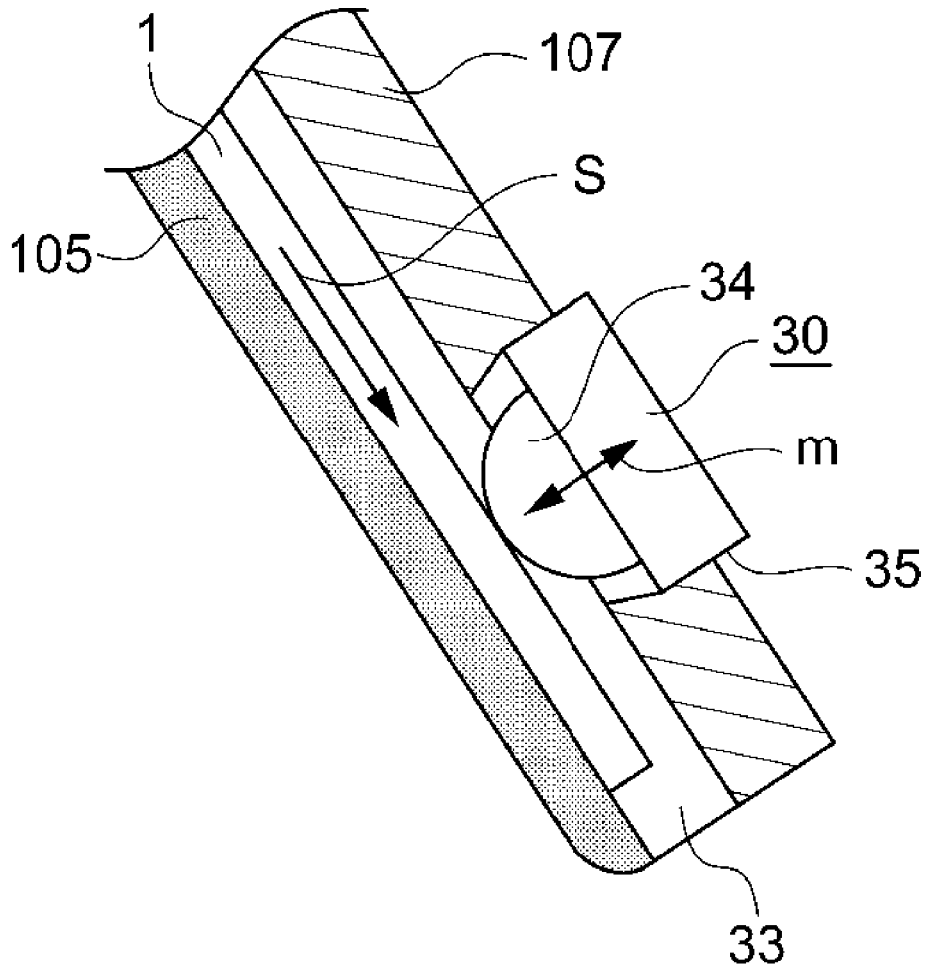
FIG. 6A is a side cross-sectional view of a main portion of a distribution limiting device which limits an entry and exit of a card from a card storage portion of the card distribution device in the first embodiment of the present invention.

Next, the distribution restricting device 30 which restricts the entering and exiting of the cards 1 from the card containing portion 102 will be described with reference to FIGS. 5 and 6A. The distribution restricting device 30 is provided to a card guide 107 of the card guiding portion 105 which guides the card 1 extracted one by one from the opening portion 106 in the front side of the card containing portion 102 onto the gaming table 4. The distribution restricting device 30 has a structure where, when the card 1 passes through a slot 33 between the card guiding portion 105 and the guide cover of the card guide 107, a lock member 34 presses the card 1 to prevent the entering and exiting of the card 1 in the slot 33. The lock member 34 is moved by a driving unit 35 such as an electronic solenoid or a piezoelectric device as illustrated by an arrow m so as to take two states of a position (limiting position) of pressing the card 1 and a pass enabling position of enabling the card 1 to pass. The driving unit 35 is controlled by a control unit 109 which is directly or indirectly connected to the control device 14 in a wired or wireless manner to move the lock member 34 to the two states of the position of pressing the card 1 and the pass enabling position of enabling the card 1 to pass. The rule of the baccarat game is programed and stored in advance in the control unit 109.

Figure 6B:
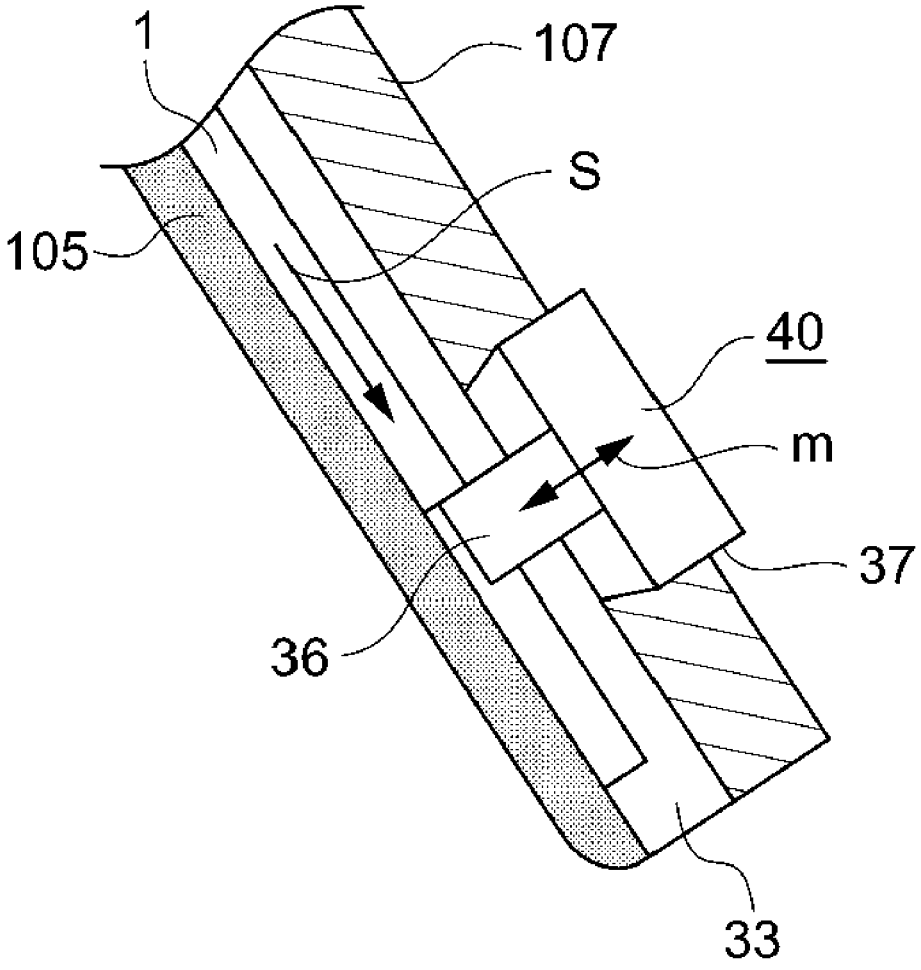
FIG. 6B is a side cross-sectional view of a main portion showing a modified example of the distribution limiting device which limits the entry and exit of the card from the card storage portion of the card distribution device in the first embodiment of the present invention.

Next, a modified example of the distribution restricting device 30 will be described with reference to FIG. 6B. In the modified example, the distribution restricting device 40 has a structure where, when the card 1 passes through the slot 33 between the card guiding portion 105 and the card guide 107 (guide cover), the lock member 36 projects into the slot 33 to prevent the movement of the card 1. The lock member 36 is moved by a driving unit 37 such as an electronic solenoid or a piezoelectric device as illustrated by an arrow m so as to take two states of a position (limiting position) of preventing the movement of the card 1 and a pass enabling position of enabling the card 1 to pass. The driving unit 37 is controlled by the control unit 109 which is connected to the control device 14 to move the lock member 36 to the two states of the position of preventing the movement of the card 1 and the pass enabling position of enabling the card 1 to pass.

Next, details of the code reading unit 108 which reads a code 52 representing a digit (number, rank) of the card 1 from the card 1 when the card 1 is manually extracted from the card containing portion 102 will be described. FIG. 5 is a plan diagram illustrating main components of the card distribution device 3. In the figure, the code reading unit 108 is provided to the card guiding portion 105 which guides the card 1 manually extracted one by one from the opening portion 106 in the front side of the card containing portion 102 onto the gaming table 4. The card guiding portion 105 is formed to have a slanted surface, and the card guides 107 functioning as a sensor cover are provided to two edges of the card guiding portion. In addition, each of the two card guides 107 is formed detachable by using a screw or the like (not shown). If the card guides 107 are detached, sensor groups 115 of the code reading unit 108 are exposed. The sensor group 115 is configured with four sensors including two UV-ray sensitive sensors (UV sensors) 20 and 21 and object detection sensors 22 and 23.

The object detection sensors 22 and 23 are optical-fiber type sensors of detecting the existence of the card 1 and can detect the movement of the card 1. One object detection sensor 22 is located at the upstream side of the card guiding portion 105 in the card 1 flowing direction, and the other object detection sensor 23 is located at the downstream side. As illustrated in the figure, the two object detection sensors 22 and 23 are provided at the respective upstream and downstream sides to interpose the UV sensors 20 and 21. The UV sensors 20 and 21 have LEDs (UV LEDs) emitting a UV ray and sensors. A mark M of the code 52 is printed on the card 1 by using UV ray emitting ink which exhibits color if the ink is hit by the UV ray. By irradiating the card 1 with the UV ray (black light), reflected light of the mark M of the code 52 of the card 1 is sensed by the sensor. The UV sensors 20 and 21 are connected to the code reading unit 108 and the control unit 109 through cables. In the code reading unit 108, a combination of the marks M is determined and the number (rank) corresponding to each code 52 is determined from the output signal of the sensors, that is, the UV sensors 20 and 21.

In the code reading unit 108, starting and ending of the UV sensors 20 and 21 are controlled by the control unit 109 based on the detection signals of the object detection sensors 22 and 23. In addition, the control unit 109 determines based on the detection signals of the object detection sensors 22 and 23 whether or not the card 1 passes through the card guiding portion 105 normally. As illustrated in FIG. 7, two rows and four columns of the rectangular marks M representing the rank (number) and suit (heart, spade, or the like) of the card are arranged in the edge of the card 1. If the UV sensors 20 and 21 sense the mark M, the sensors output "on" signals. The code reading unit 108 determines a relative relationship between the two signals input from the two UV sensors 20 and 21. Therefore, the code reading unit 108 specifies the code according to a relative difference between the two marks M sensed by the two UV sensors 20 and 21 to specify the number (rank) and type (suit) of the corresponding card 1.

The relationship between the code 52 and the outputs of the "on" signals of the two UV sensors 20 and 21 is illustrated in FIG. 7. Based on the result of comparison of the relative change of the outputs of the "on" signals of the UV sensors 20 and 21, a predetermined combination of the marks M can be specified. As a result, four combinations of the marks M of the up and down two columns are obtained, and if the four combinations are printed in four columns, 4 to the 4th power, that is, 256 types of codes can be configured. By assigning 52 types of cards of the playing cards to 256 types of the codes, details of the assignment is stored as a comparison table in a memory or as a program, and the code reading unit 108 is configured so that, by specifying each code 52, the number (rank) and type (suit) of the card 1 is specified from a pre-defined comparison table (not shown). In addition, since the 256 types of the codes are stored in the comparison table in a manner that the codes are freely combined to be in association with the 52 types of the cards, the combinations may be complicated, and thus, the combinations of the 256 types of the codes and the 52 types of the card can be changed according to time and location. It is preferable that the code is printed by using a paint which is visualized by being irradiated with UV light and the code is printed at a position where the codes do not overlap a type indicator or index 103 of the card.

Figure 8:
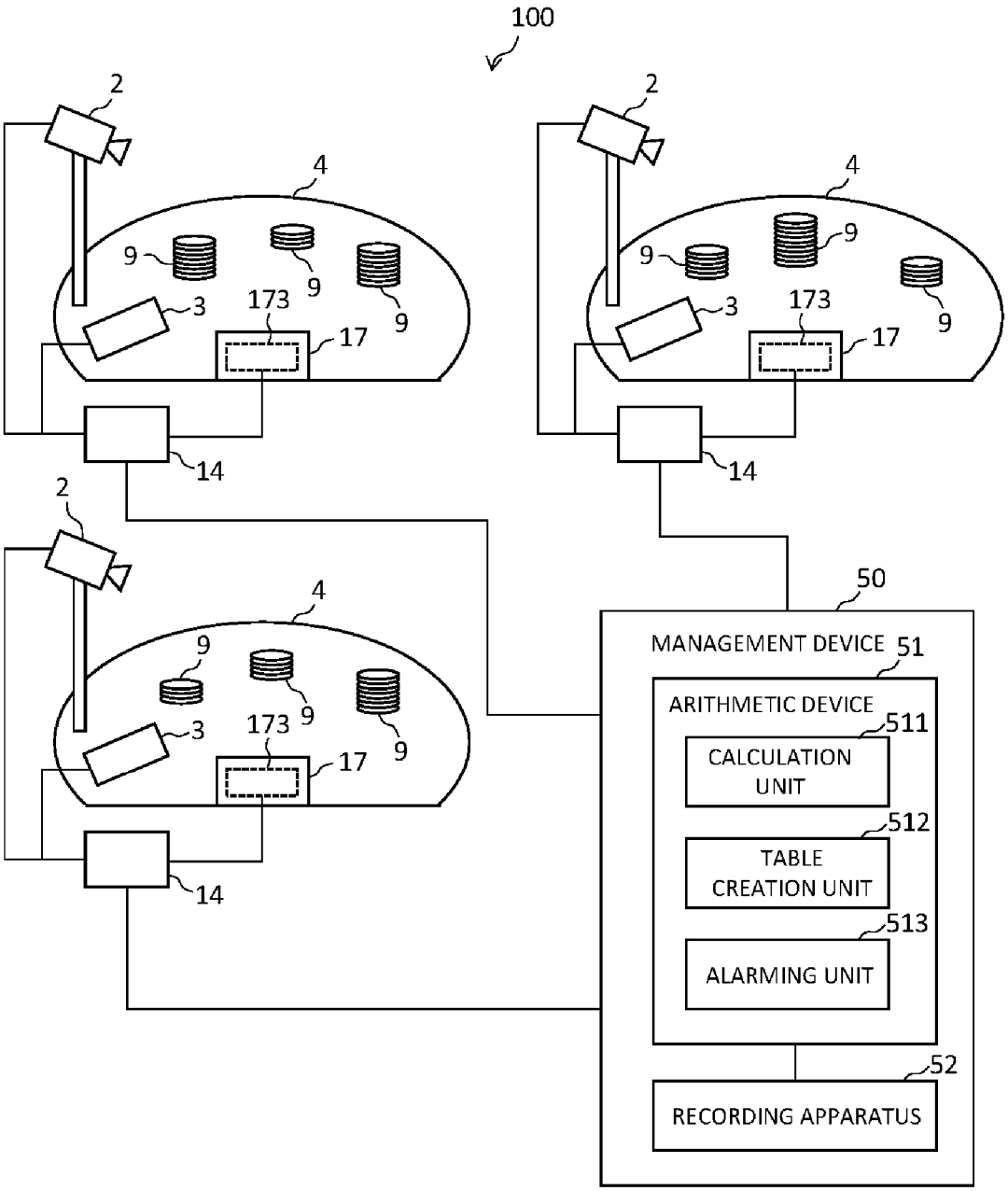
FIG. 8 is a schematic diagram of a casino facility incorporating a game management system according to the first embodiment of the present invention.

Hereinafter, the game management system of this embodiment will be described with reference to the drawings. FIG. 8 is a schematic view of casino facilities to which a game management system 100 of this embodiment is introduced. As illustrated in FIG. 8, a plurality of gaming tables 4 are disposed in the casino facilities, and a casino game is performed in each of the gaming tables 4. In the gaming table 4, one side is a dealer side on which a dealer is positioned, and the other side is a player side on which a player is positioned. In the example of FIG. 8, an upper side of each of the gaming tables 4 is the player side, and a lower side is the dealer side.

Betting is performed on the gaming table 4 by using chips 9. In each game, the player places the type and the number of chips 9 to be bet by himself in an area corresponding to a betting target on the gaming table 4, and thus, performs betting.

In chips 9, the design of a front surface and a side surface is different for each type, and any one of the front surface and the side surface is observed, and thus, the type can be specified. In this embodiment, a value different for each type (for example, 1000 dollars, 100 dollars, 10 dollars, or the like) is applied to the chips 9. Accordingly, the type is specified, and thus, the value of the chip 9 is specified.

An RF tag recording information of being capable of specifying at least the type is built in the chips 9. The information recorded in the RF tag (RF tag information) may include information indicating the type of chip 9, or may include identification information uniquely specifying the chips 9. In a case where the RF tag information is the identification information, a database is prepared in which information of a type corresponding to the identification information is stored, and thus, it is possible to specify the type corresponding to the identification information read out from the chips 9, with reference to the database. In this embodiment, both of the information indicating the type and the identification information are recorded in the RF tag of the chip 9, and the value can be specified by the information indicating the type.

A chip tray 17 is disposed on a dealer side of the gaming table 4. The chips 9 of the dealer are contained in the chip tray 17. An antenna 173 for reading out the RF tag information of the RF tag built in the chips 9 is disposed on the inside or the outside of the chip tray 17. The antenna 173 receives an electrical wave from the RF tag of the chips 9 contained in the chip tray 17.

A card distribution device 3 which also functions as a win or lose determination device is disposed on the gaming table 4 to be used. As described above, in this embodiment, the card distribution device 3 determines a win or lose result of any one of for each game, according to a rule of a baccarat game the winning of the player, the winning of a banker, and a tie. That is, the card distribution device 3 is an electronic shoe including a card containing portion 102 containing playing cards 1s, a card guiding portion 105 and an opening portion 106 configuring an extraction mechanism for extracting the playing cards is one by one from the card containing portion 102, card detection sensors 22 and 23 and a card reading unit 108 configuring a detection unit detecting the contents of the playing cards 1 extracted by the extraction mechanism, and a control unit 109 as a determination unit determining a game result of the baccarat game on the basis of the contents of the playing cards detected by the card reading unit 108, according to the rule of the baccarat game.

A camera 2 is disposed on each of the gaming tables 4. The camera 2 is attached to a tip end of a pole extending towards the upper side, and is disposed on a high portion of the gaming table 4. A capturing direction and an angular field of the camera 2 are set such that the camera 2 is capable of capturing a range including at least a betting area of the gaming table 4 (an area where the player places the chips 9 in order for betting), the card distribution device 3, and the chip tray 17. The camera 2 is capable of obtaining an image by capturing the bet chips.

Furthermore, in the example of FIG. 8, one camera 2 is disposed on each of the gaming tables 4, but a plurality of cameras 2 of which at least one of the dispose positions, the capturing directions, or the angular fields are different from each other, may be disposed on each of the gaming tables 4 to capture different ranges. For example, the camera 2 capturing the betting area and the camera 2 capturing the chip tray 17 may be separately disposed, or the same betting area may be captured by a plurality of cameras of which the disposition heights are different from each other, and the capturing directions are different from each other.

A control device 14 is further disposed on each of the gaming tables 4. The control device 14 is connected to the camera 2 of the gaming table 4 (in a case where the number of cameras 2 is plural, a plurality of cameras 2), the card distribution device 3, and the RF antenna 173. The control device 14 has a plurality of functions as an information processing device.

First, the control device 14 has a function as an RF reader, which specifies the type of all of the chips 9 contained in the chip tray 17, on the basis of the electrical wave received by the antenna 173, calculates the total amount of the chips 9 contained in the chip tray 17, and records the total amount. In addition, the control device 14 has a function of receiving the win or lose result of each of the games from the card distribution device 3, and of recording the result. Further, the control device 14 has a function as an image recognition device, which acquires a captured image from the camera 2, performs image recognition using a machine learning model, with respect to the captured image, and recognizes betting contents, that is, how much the player bets on the betting target, which player bets, which betting target the player bets on. The machine learning model may be a neural network of a deep learning structure. Specifically, the control device 14 specifies the player and the betting target on the basis of the positions of the chips 9 in the captured image, and specifies the betting amount on the basis of the type and the number of chips 9 in the captured image.

Thus, the control device 14 recognizes the total amount of the chips 9 contained in the chip tray 17 (hereinafter, also referred to as a "dealer amount") by using the antenna 173, recognizes the win or lose result of the game (hereinafter, also referred to as a "game result") by using the card distribution device 3, and recognizes the betting contents by using the image from the camera 2, for each game, on each of the gaming tables 4. It is possible to calculate the sales and the profit of the casino manager in each of the games, on the basis of such information (the chip tray total amount, the game result, and the betting contents).

The game management system 100 includes a management device 50 connected to the control device 14 of the plurality of gaming tables 4. The management device 50 is configured of a general-purpose computer. The management device 50 includes an arithmetic device 51 and a recording apparatus 52. The general-purpose processor executes a computer program of this embodiment, and thus, the arithmetic device 51, for example, is realized. The arithmetic device 51 includes a calculation unit 511, a table creation unit 512, and an alarming unit 513.

The calculation unit 511 acquires the information of the dealer amount, the game result, and the betting contents for each game, from the plurality of control devices 14, and calculates the sales, the profit (the gross), and the profit rate (a gross rate) for each gaming table 4. The table creation unit 512 creates a table and a graph in which the sales and the profits calculated by the calculation unit 511 are arranged in time series for each table.

Furthermore, the calculation unit 511 may calculate the sales, the profit, and the profit rate for each position of the player on each of the gaming tables 4, and the table creation unit 512 may create the table and the graph in which the sales, the profits, and the profit rates are arranged in time series for each position of the player on each of the gaming tables 4. In addition, in a case where the game management system 100 includes a section recognizing the player, the sales according to the betting of the player and the profit obtained from the player may be calculated, and the table and the graph may be created, for each player.

The recording apparatus 52 records the sales, the profit, and the profit rate calculated by the calculation unit 511, in the form of the table and the graph created by the table creation unit 512.

Specifically, the calculation unit 511 calculates the total amount (the sales) of the betting amount for each of the plurality of gaming tables 4 and each game, obtains the degree of collection or the redemption with respect to which betting target, on the basis of the betting target, the betting amount, and the game result, and calculates the profit of the casino manager. In addition, the calculation unit 511 obtains a difference in the dealer amount before and after the table game, for each of the plurality of gaming tables 4 and each game, and thus, calculates the profit of the casino manager. The profit of the former is a so-called theoretical value, and the profit of the latter is a so-called result value, and it is necessary that the theoretical value and the result value are coincident with each other. The calculation unit 511 determines whether or not the theoretical value and the result value are coincident with each other, and in a case where the theoretical value and the result value are coincident with each other, the profit is adopted, and in a case where the theoretical value and the result value are not coincident with each other, a warning to that effect may be generated.

The calculation unit 511 further calculates the total amount (the sales) of the betting amount for each of the plurality of tables 4 and each game. In addition, the calculation unit 511 calculates the profit rate (the gross rate) (=Profit/Sales) on the basis of the sales and the profit (the gross) of a predetermined period or a predetermined number of games.

The table creation unit 512 adds up the sales, the profit, and the profit rate calculated by the calculation unit 511, and creates various tables and graphs. FIG. 9 is an example of a table indicating the sales (the total amount of the betting amount) for each gaming table 4, created by the table creation unit 512. As illustrated in FIG. 9, the table creation unit 512 creates a table indicating the number of bet chips 9 of each type for each gaming table 4. The number of respective chips 9, for example, may be an added-up number for each predetermined time such as a time period from 0 hours to 0 hours on the next day. In a case where the casino facilities are not in 24-hour operations, the number of respective chips 9 may be an added-up number for each business hour for one day. Further, the number of respective chips 9 may be an added-up result within a predetermined time in the past, on the basis of a creation time. The table further includes the total amount of chips (the sales) in each of the gaming tables 4. According to the table, it is possible to compare the sales in the same time zone for each gaming table, and to know the total sales of the all of the casino facilities in the time zone.

FIG. 10 is an example of a table indicating the sales for each game in each of the gaming tables 4, created by the table creation unit 512. FIG. 10 is a table illustrating the sales with respect to Table 1. As illustrated in FIG. 10, the table creation unit 512 creates a table indicating the number of various bet chips 9 for each game. The table creation unit 512 may create one table by separating the table for certain period of time (for example, 24 hours or one business day), or may create a table for each predetermined number of games (for example, 80 games). In addition, the table creation unit 512 may create a table within a predetermined time in the past or for a predetermined number of games, at a table creation time point.

FIG. 11 is an example of a table indicating the total amount of the betting amount (the sales), the profit (the gross), and the profit rate for each gaming table 4, created by the table creation unit 512. As illustrated in FIG. 11, the table creation unit 512 creates a table indicating the total amount of the betting amount (the sales) (the total betting amount), the profit (the gross) (the gross profit), the profit rate (the gross rate) (=Profit/Sales) (a profit ratio) for each gaming table 4. The table creation unit 512 may create one table by separating the table for a certain period of time (for example, 24 hours, one week, one month, or the like), or may create a table for each predetermined number of games (for example, 100 games, 1000 games, or the like). In addition, the table creation unit 512 may create a table within a predetermined time in the past or for a predetermined number of games, at a table creation time point.

Figure 12:
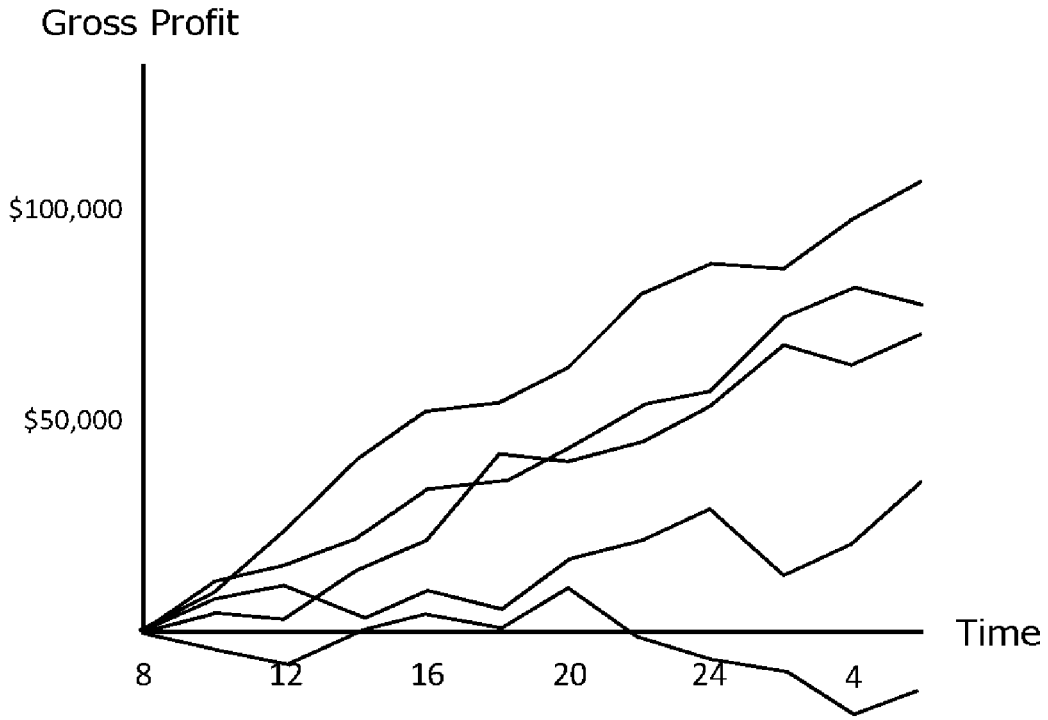
FIG. 12 is a diagram showing an example of polygonal line graphs showing transitions of profits in each gaming table according to the first embodiment of the present invention.
Figure 13:
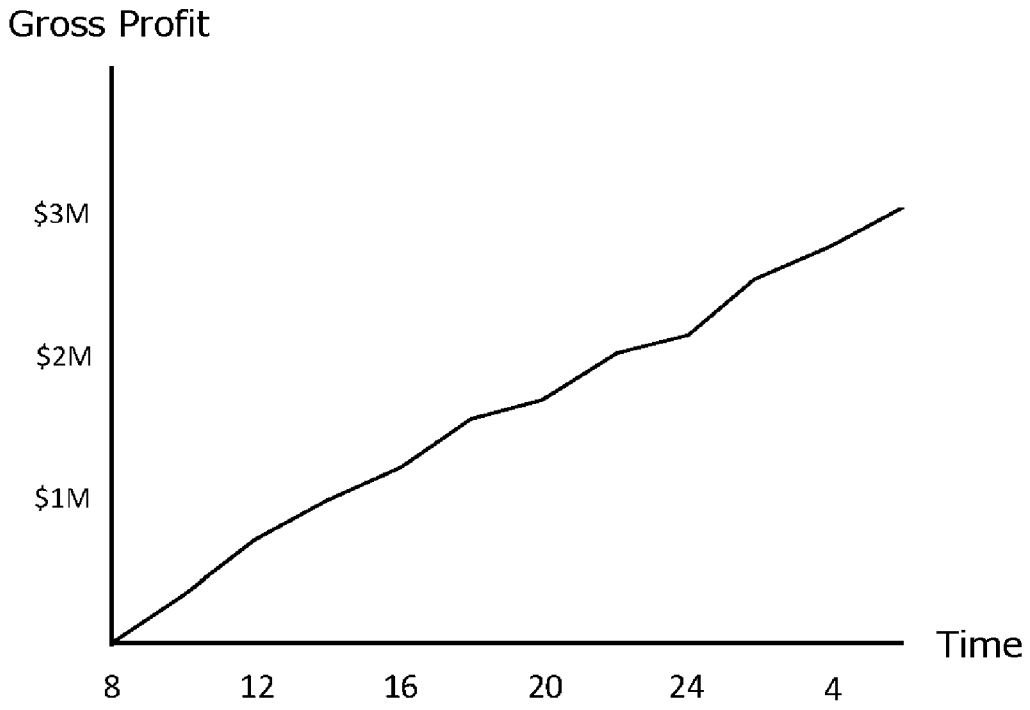
FIG. 13 is a diagram showing an example of a graph showing a transition of profit of the whole casino facility according to the first embodiment of the present invention.

FIG. 12 is an example of a polygonal line graph illustrating a transition of the profit in each of the gaming tables 4, created by the table creation unit 512, and FIG. 13 is an example of a graph illustrating a transition of the profit of all of the casino facilities. In case where the casino facilities are operated from 8 a.m. to 6 a.m. on the next day, the transition of the profit for one business day is illustrated in the examples of FIG. 12 and FIG. 13. According to the graph as illustrated in FIG. 12 or FIG. 13, the transition of the profit is easily understood, and thus, it is possible to perform business analysis of the casino facilities. In addition, the transition of the profit for each table is indicated as illustrated in FIG. 12, and thus, a table having a peculiar transition of the profit is easily found.

Figure 14:
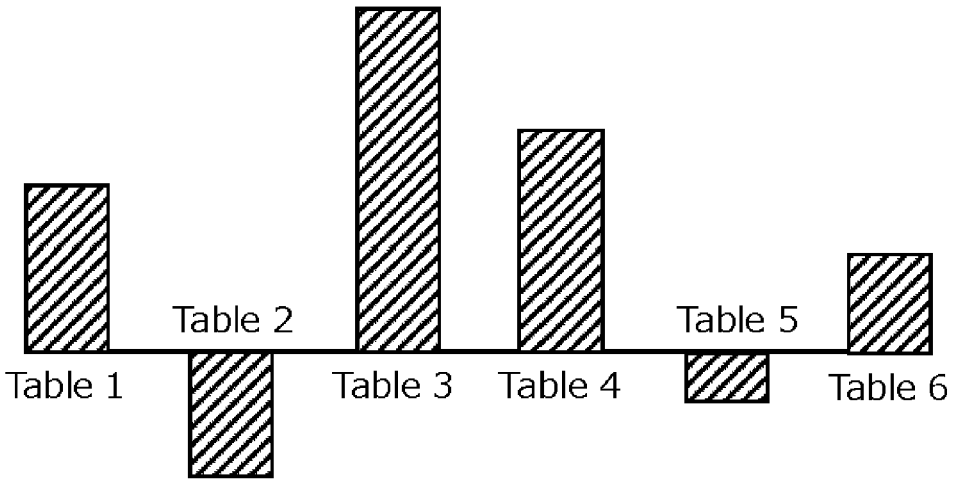
FIG. 14 is a diagram showing an example of a bar graph showing profit ratios for each gaming table according to the first embodiment of the present invention.

FIG. 14 is an example of a bar graph illustrating a profit rate for each gaming table 4, created by the table creation unit 512. According to the bar graph, the quantity of the profit obtained in each of the gaming tables 4 becomes obvious.

Furthermore, in the examples described above, the calculation unit 511 and the table creation unit 512 calculate the sales, the profit, and the profit rate for each gaming table 4, and create the table or the graph, but instead thereof or in addition thereto, may calculate the sales, the profit, and the profit rate for each pit in which the plurality of gaming tables 4 are collected, and may create a table or a graph.

The calculation unit 511 may calculate the sales, the profit, and the profit rate whenever the information of the dealer amount, the game result, and the betting contents is acquired for each game, or may calculate the sales, the profit, and the profit rate at a timing when the table creation unit 512 creates a table.

The table creation unit 512 may create a table for each period targeted by the table or the graph. For example, in a case where the table creation unit 512 creates a graph illustrating a transition of the sales for one day (for 24 hours) on each of the gaming tables 4, the table may be automatically created every 24 hours (as soon as the data is collected). Alternatively, the table creation unit 512 may create the table or the graph at a manually indicated timing, regardless of the period targeted by the table or the graph. Alternatively, the table creation unit 512 may automatically create the table or the graph at an interval shorter than the period targeted by the table or the graph. For example, adding-up for 24 hours in the past may be performed every 6 hours, and thus, the table or the graph may be created.

The alarming unit 513 determines that a peculiar situation occurs on the basis of the sales, the profit, and the profit rate calculated by the calculation unit 511, and the adding-up of the table creation unit 512, and generates an alarm. For example, the alarming unit 513 may compare the profit rate calculated by the calculation unit 511 or the profit rate for a predetermined period or for a predetermined number of games, added up by the table creation unit 512, with a predetermined first threshold value, and may generate an alarm when the profit rate is less than or equal to the first threshold value, or may compare the profit rate calculated by the calculation unit 511 or the profit rate for a predetermined period or for a predetermined number of games, added up by the table creation unit 512, with a predetermined second threshold value, and may generate an alarm when the profit rate is greater than or equal to the second threshold value. In addition, the alarming unit 513 may compare the profit and the sales with a predetermined threshold value, and thus, may generate an alarm.

The alarming unit 513 may perform more complicated analysis with respect to the sales or the profit, and may find a peculiar situation. For example, the alarming unit 513 may generate an alarm on the basis of the transition of the profit rate in the table or graph created by the table creation unit 512. In this case, the peculiar situation may be determined by using the machine learning model. The machine learning model may be a model of outputting a probability of being peculiar by using the transition of the profit rate obtained by the adding-up of the table creation unit 512 as input, and in a case where the probability is less than or equal to a predetermined threshold value, the alarming unit 513 may determine that it is the peculiar situation, and may generate an alarm.

The alarm may be realized by a section of attaching a mark to an element which is determined as being peculiar in the table or the graph created by the table creation unit 512, and in addition, in a case where such a peculiar situation occurs, the alarm may be realized by generating and outputting an image, a sound, a driving signal of an alarm device (a lamp, a buzzer, or the like), and the like. In the example of FIG. 11, the alarm is realized by hatching Table 3 in which the profit rate is less than 0%.

As described above, according to the above embodiment, in the game table 4, the bet contents are determined by the camera 2 and the control device 14 as the image recognition device, the game result is determined by the card distribution device 3, and the dealer amount is determined by the antenna and the RF reader and the information is intensively managed by the management devices 50 and 60, and as a result, it is possible to automatically determine the sales, the profit, the profit rate, etc. of a casino operator.

In the embodiment described above, the win or lose determination device is realized by the card distribution device 3, that is, the card distribution device 3 has a configuration of performing win or lose determination, but the win or lose determination may be performed by the control device 14. In this case, from the card distribution device 3, the information read out from the distributed card (card reading information) is transmitted to the control device 14, and the control device 14 determines the win or lose result of the game according to the game rule, on the basis of the card reading information from the card distribution device 3, as the win or lose determination device.

In addition, in the embodiment described above, the calculation unit 511 calculates the sales, the profit, and the profit rate, and the table creation unit 512 creates the table or the graph by adding up the calculated sales, profit, and profit rate, but instead thereof, a part or all of the adding-up may be performed by the calculation unit 511, and the table creation unit 512 may create the table or the graph by using the added-up result of the calculation unit 511.

Second Embodiment

Figure 15:
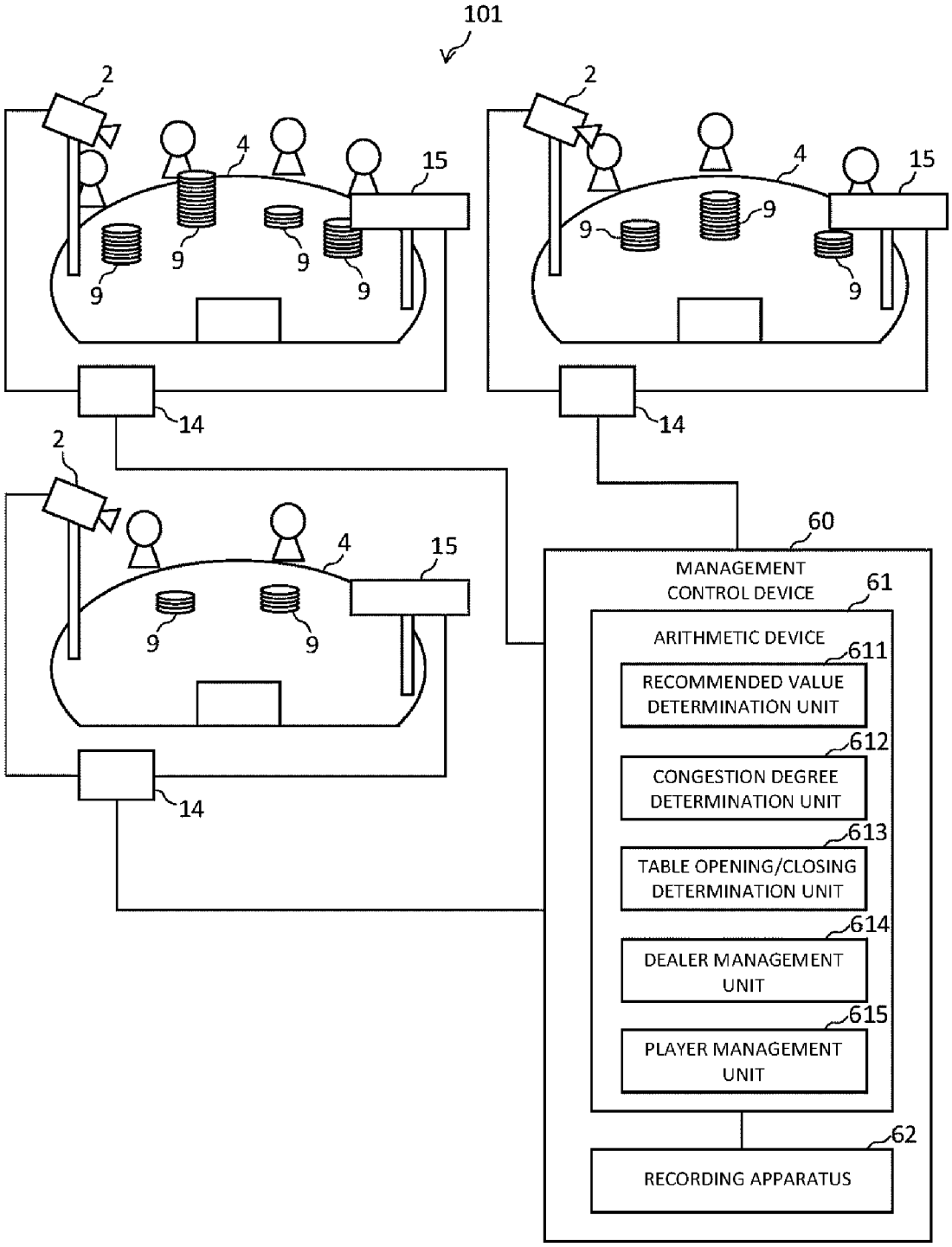
FIG. 15 is a diagram showing the overall configuration of a game management system according to a second embodiment of the present invention.

FIG. 15 is a diagram showing the overall configuration of a game management system 101 according to a second embodiment of the present invention. The game management system 101 includes a plurality of gaming tables 4 on which a casino game is performed and a management control device 60 which manages games in each gaming table 4, and manages casino games which are performed by a plurality of gaming tables 4 in a casino facility. The plurality of gaming tables 4 are arranged in each area of the casino facility. In the present embodiment, the fixed number of each gaming table 4 is eight, that is, the gaming table 4 has eight player positions.

Each gaming table 4 is provided with a camera 2. The camera 2 is fixed to a pole. By photographing a bet area on the gaming table 4, the camera 2 photographs chips 9 placed in the bet area to obtain images. The camera 2 also photographs the player positions to photograph players who participate in a game on the gaming table 4, thereby obtaining the images.

Although FIG. 15 shows an example in which one camera 2 is installed in each gaming table 4, a camera for photographing a bet area and a camera for photographing a player may be separately installed, and furthermore, a plurality of cameras for photographing different portions in the bet area may be installed or a plurality of cameras for photographing different player positions may be installed. In addition, the bet area and the player may each be photographed by changing an angle between an angle at which one camera 2 photographs the bet area and an angle at which a player is photographed.

Each gaming table 4 is provided with a display 15 as a display device. The display 15 is fixed to a pole provided on the gaming table 4, and is installed at a position where not only players participating in the game but also those thereabout can view the display 15. Various pieces of information including the minimum bet amount set in the gaming table 4 are displayed on the display 15.

The display 15 is typically a liquid crystal panel, but may be a display device in which LED lamps are two-dimensionally disposed. In addition, in the example of FIG. 15, the camera 2 and the display 15 are separately installed, but may be fixed to the same pole. For example, it is possible to make the camera 2 inconspicuous by installing the camera 2 just under the display 15.

Each gaming table 4 is provided with a control device 14 as an information processing device. A computer executes a predetermined program, so the control device 14 realizes a plurality of functions to be described below. First, the control device 14 analyzes the image of the bet area obtained by the camera 2, thereby specifying a bet amount at each player position of the gaming table 4 on the basis of the position, the type, and the number of chips 9 in the image. For analyzing this image, various image recognition techniques can be adopted. For example, the bet amount at each player position may be obtained as an output by inputting the image of the bet area to a learned deep neural network.

The control device 14 further functions as a player number determination device which analyzes the image of the player position to determine the number of players participating in the game on the gaming table 4. The existing face recognition technology can be used for this identification of the player, and may use machine learning such as a support vector machine (SVM) or the like.

The control device 14 also has a function as a display control device which performs a control to display the predetermined information on the display 15. Further, the control device 14 may be connected to an operation input device (not shown), and may receive an operation input of a dealer from the operation input device. Further, the control device 14 may be connected to a card distribution device having a win/loss determination function on the gaming table 4, an RFID system reading an RF tag embedded in the chip 9 or the like, and may perform various kinds of information processing thereon.

The control device 14 provided in each gaming table 4 is connected to a management control device 60 in a wired or wireless communication manner. The management control device 60 includes an arithmetic device 61 and a recording apparatus 62, and the arithmetic device 61 includes a recommended value determination unit 611 realized by allowing a processor to execute a predetermined program, a congestion degree determination unit 612, a table opening/closing determination unit 613, a dealer management unit 614, and a player management unit 615.

Based on information on a bet amount specified by the control device 14 and information on the number of players determined by the control device 14 functioning as the player number determination device, the recommended value determination unit 611 determines a recommended value of a minimum bet amount for each gaming table 4. The recommended value determination unit 611 determines the recommended value of the minimum bet amount for each gaming table 4 so as to increase a profit ratio to sales. In addition, the recommended value determination unit 611 may determine the recommended value of the minimum bet amount for each gaming table 4 so as to increase the number of games per unit time or an average value of the total bet amounts per game.

Candidates for the minimum bet amount divided into a plurality of stages are set in the recommended value determination unit 611. In the present embodiment, candidates for a minimum bet amount of five stages such as 100 dollars, 500 dollars, 1,000 dollars, 5,000 dollars, and 10,000 dollars are set in the recommended value determination unit 611. The recommended value determination unit 611 determines a recommended value by selecting one of these candidates for the minimum bet amount. In addition, the recommended value determination unit 611 determines the recommended value of more appropriate minimum bet amount in addition to the set candidates, so that it may be possible to perform classification more finely when the candidates for the preset minimum bet amount is inappropriate.

The management control device 60 outputs (transmits) the determined recommended value of the minimum bet amount to the control device 14 of the corresponding gaming table 4. The control device 14 displays the minimum bet amount on the display 15 on the basis of the recommended value received from the management control device 60. When receiving the recommended value of the minimum bet amount from the management control device 60, the control device 14 may display the recommended value on the display 15 as it is or may display the recommended value only to the dealer once and may display the recommended value on the display 15 in accordance with the operation of the dealer.

(Recommendation of Minimum Bet Amount Based on Actual Bet Amount)

The recommended value determination unit 611 determines the recommended value by selecting the candidates for the minimum bet amount divided into a plurality of stages on the basis of the information on the number of players determined by the control device 14 as the player number determination device, the information on the bet amount which is the lowest amount among the bet amounts at each player position or the information on the average bet amount.

The recommended value determination unit 611 determines the total bet amount for each gaming table, each game and/or each predetermined time or period, and determines the recommended value of the minimum bet amount for each gaming table 4. In the present embodiment, the recommended value determination unit 611 increases the recommended value of the minimum bet amount when the number of players betting at a predetermined ratio or more with respect to the current minimum bet amount for the gaming table 4 is equal to or more than a predetermined ratio.

Specifically, the recommended value determination unit 611 ranks as a high betting player a player in which the minimum amount among the bet amounts of the predetermined number of past games (five games in the present embodiment) at each player position for each gaming table 4 is equal to or more than a predetermined ratio (150% in the present embodiment) of the minimum bet amount. When the high betting player is equal to or more than the predetermined ratio (50% in the present embodiment), the recommended value determination unit 611 determines as the recommended value the minimum bet amount which is more than the already set minimum bet amount for each gaming table 4.

FIGS. 16A and 16B are diagrams showing an example of determining a recommended value of a minimum bet amount according to an actual bet amount. In the example of FIGS. 16A and 16B, four players are participating in the game, and the minimum bet amount is set to 1,000 dollars.

In the example of FIG. 16A, the lowest amount among bet amounts in the past five games of a player 1 is 1,000 dollars, the lowest amount among bet amounts in the past five games of a player 2 is 2,000 dollars, the lowest amount among bet amounts in the past five games of a player 3 is 1,500 dollars, and the lowest amount among bet amounts in the past five games in a player 4 is 1,000 dollars. In this case, for the player 2 and the player 3, the minimum bet amount of the past five games is equal to or more than 1,500 dollars which is equal to or more than 150% of the current minimum bet amount of 1,000 dollars, and the player 2 and the player 3 are ranked as the high betting player. Since a ratio of high betting players (two players) among four players participating in a game is 50% and reaches 50% as a reference, the recommended value determination unit 611 determines as the recommended value the minimum bet amount more than the minimum bet amount of 1,000 dollars already set.

In the example of FIG. 16B, the lowest amount among bet amounts in the past five games of a player 1 is 1,000 dollars, the lowest amount among bet amounts in the past five games of a player 2 is 1,500 dollars, the lowest amount among bet amounts in the past five games of a player 3 is 1,000 dollars, and the lowest amount among bet amounts in the past five games in a player 4 is 1,100 dollars. In this case, for the player 2, the lowest bet amount of the past five games is equal to or more than 1,500 dollars which is 150% of the current minimum bet amount of 1,000 dollars, and the player 2 is ranked as the high betting player. Since a ratio of high betting players (one player) among four players participating in a game is 25% and does not satisfy 50% as a reference, the recommended value determination unit 611 determines as the recommended value the current minimum bet amount of 1,000 dollars without changing the minimum bet amount of 1,000 dollars already set.

When increasing the minimum bet amount, the recommended value determination unit 611 increases the minimum bet amount by one level and performs the same calculation as above. In the case of FIG. 16A, when the current minimum bet amount is set to 5,000 dollars which is one level higher, the condition for determining a higher minimum bet amount as a recommended value is not satisfied, so 5,000 dollars is determined as the recommended value of the minimum bet amount. When the same calculation is applied to the minimum bet amount increased by one level, and furthermore when the above condition is satisfied, the minimum bet amount increases by one level higher, and the increase in the minimum bet amount is repeated until the above condition is not satisfied.

In the above example, the recommended value determination unit 611 evaluates the lowest amount among the bet amounts of the past five games of each player position (player), but in place of this evaluation, the recommended value determination unit 611 ranks as a high betting player a player in which an average value (average bet amount) among the bet amounts of the predetermined number of past games (for example, five games) at each player position for each gaming table 4 is equal to or more than a predetermined ratio (for example, 300%).

In addition, in the above example, when the high betting player is equal to or more than the predetermined ratio, the minimum bet amount is changed to one-level high amount among the candidates already determined, but in place of this, may be increased to a predetermined ratio (for example, 150%) of the minimum bet amount. That is, in the example of FIG. 16A, 1,500 dollars which is 150% of the minimum bet amount of 1,000 dollars may be the recommended value of the minimum bet amount.

Further, the recommended value determination unit 611 may determine a transition of a bet amount for each player position in a plurality of games, and determine the recommended value of the minimum bet amount for each gaming table on the basis of the transition. Alternatively, the card distribution device 3 or the control device 14 determines the result of the game to determine the win and loss and the income and expenditure at each player position, and the recommended value determination unit 611 may determine the recommended value of the minimum bet amount for each gaming table on the basis of the information on the transition of the income and expenditure at each player position.

(Recommendation of Minimum Bet Amount according to Table Congestion Degree)

Next, the determination of the recommended value of the minimum bet amount according to the table congestion degree will be described. The congestion degree determination unit 612 calculates the table congestion degrees of each gaming table on the basis of the information on the number of players determined by the control device 14 as the player number determination device. The table congestion degree is the ratio of the number of players participating in the game to the fixed number of each gaming table 4. The recommended value determination unit 611 determines the recommended value of the minimum bet amount for each gaming table 4 according to the table congestion degree determined by the congestion degree determination unit 612.

Figure 17A:
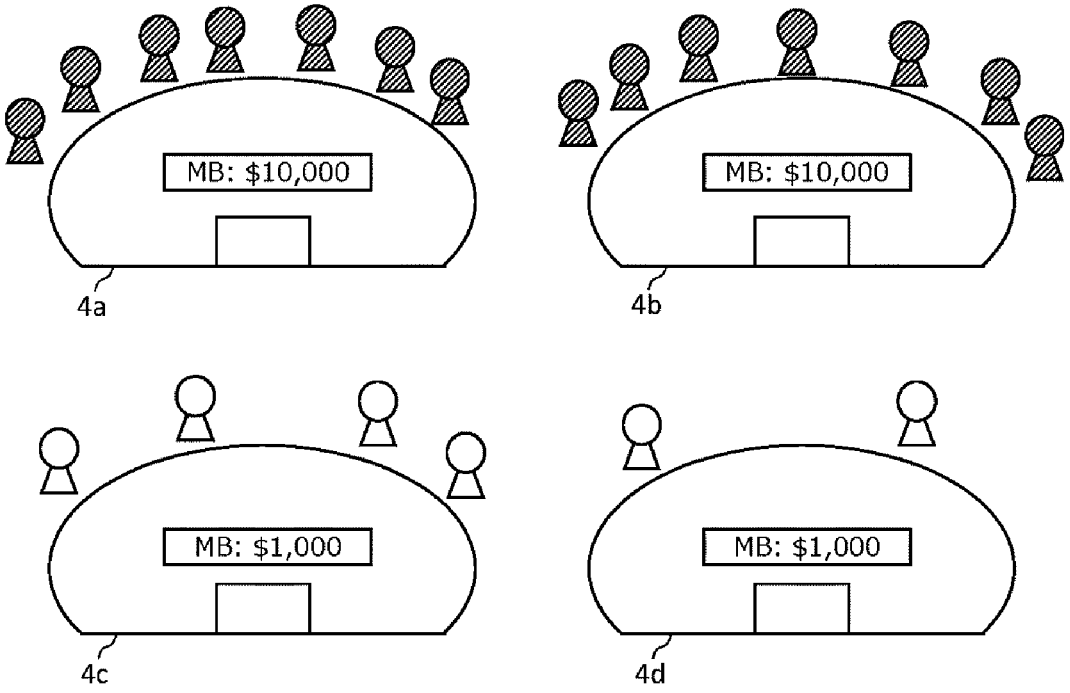
FIG. 17A is a diagram showing an example of determining a recommended value of a minimum bet amount according to a congestion degree of a table.
Figure 17B:
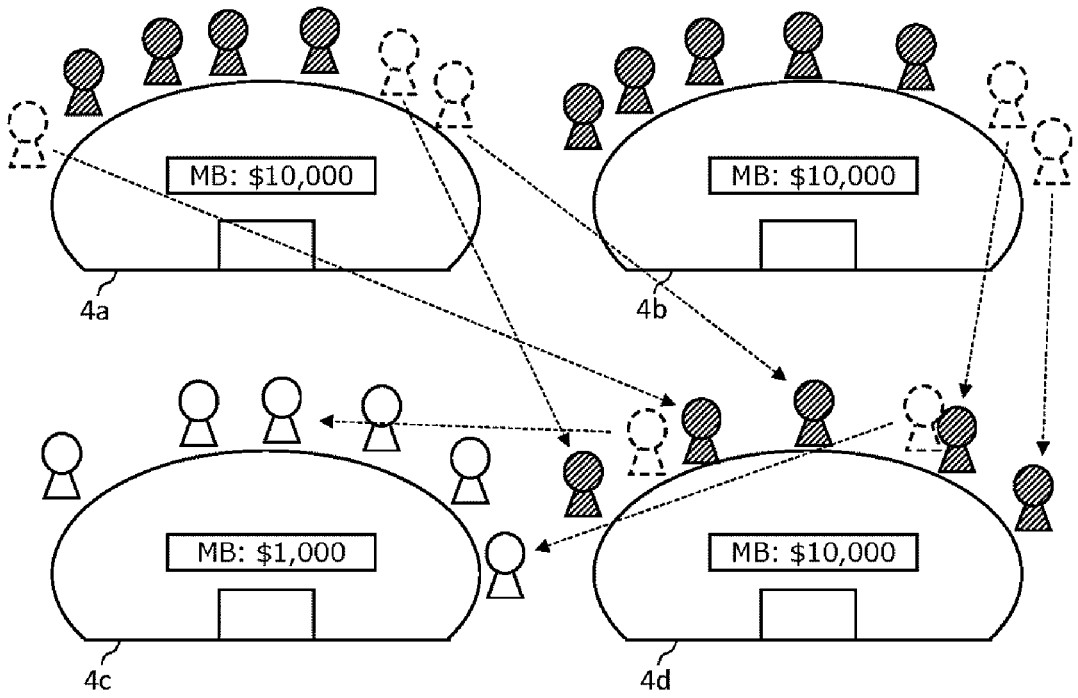
FIG. 17B is a diagram showing an example of determining the recommended value of the minimum bet amount according to the congestion degree of the table.

FIGS. 17A and 17B are diagrams showing an example of determining a recommended value of a minimum bet amount according to a table congestion degree. As shown in FIG. 17A, there are four gaming tables 4*a* to 4*d*, a minimum bet amount for two gaming tables 4*a* and 4*b* among the four gaming tables 4*a* to 4*d* is set to 10,000 dollars, and a minimum bet amount for the other two gaming tables 4*c* and 4*d* is set to 1,000 dollars.

As shown in FIG. 17A, in the case of the two gaming tables 4*a* and 4*b* whose minimum bet amount is set to 10,000 dollars, the number of players participating in a game is many (table congestion degree is high), and in the case of the two gaming tables 4*c* and 4*d* whose minimum bet amount is set to 1,000 dollars, the number of players participating in a game is small (table congestion degree is low).

Under such circumstances, the recommended value determination unit 611 increases to 10,000 dollars the minimum bet amount for the gaming table 4*d* having the smallest number of players participating in a game among the gaming tables 4*c* and 4*d* whose minimum bet amount is 1,000 dollars. By doing so, as shown in FIG. 17B, players who participate in the game on the gaming table 4*d* are expected to move to the gaming table 4*c* whose minimum bet amount is 1,000 dollars, and some of the players who participate in the game on the gaming tables 4*a* and 4*b* whose minimum bet amounts is 10,000 dollars are expected to move to the gaming table 4*d* whose minimum bet amount increases to 10,000 dollars.

Figure 20A:
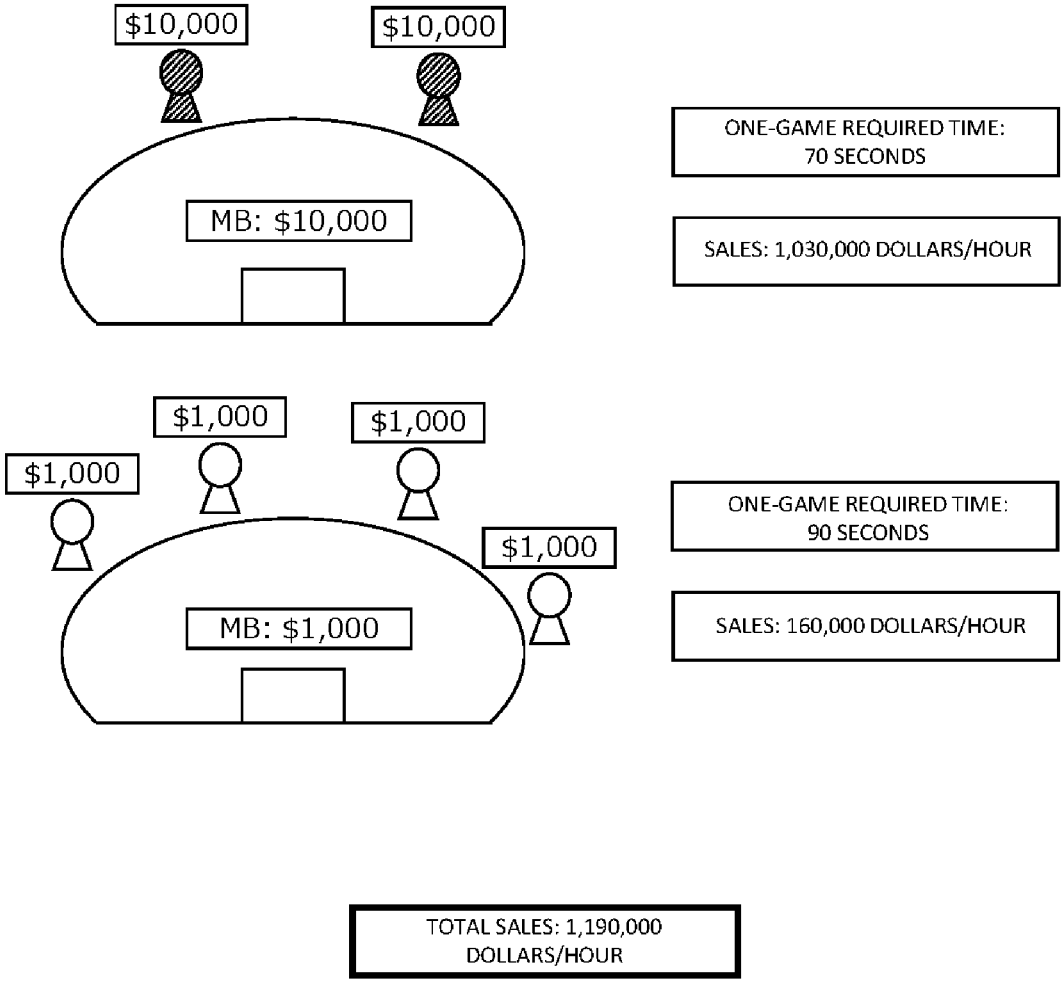
FIG. 20A is a diagram for describing another example of the situation in which the sales of the entire casino facility are kept low.
Figure 20B:
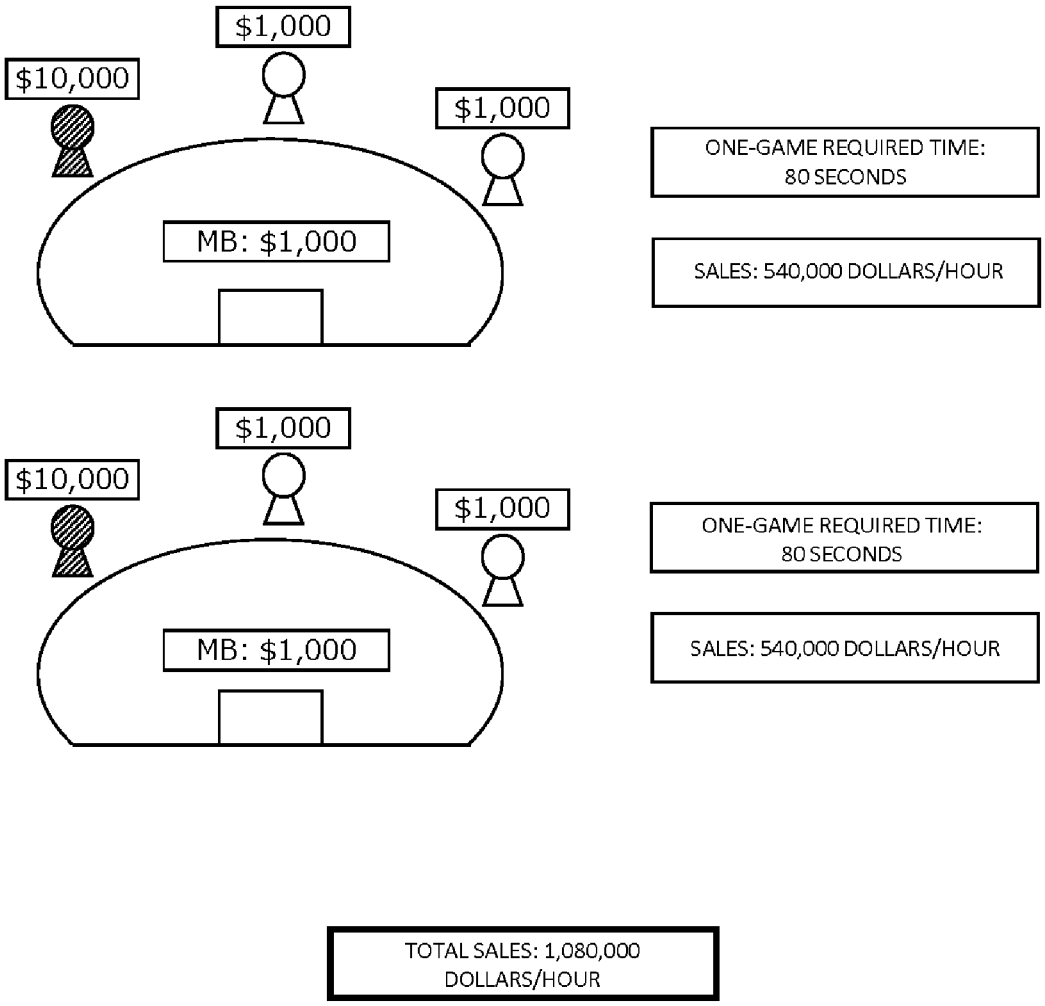
FIG. 20B is a diagram for describing still another example of the situation in which the sales of the entire casino facility are kept low.

As described with reference to FIGS. 20A and 20B, it is obvious that sales of a casino operator are higher in FIG. 17B than in FIG. 17A. As described above, the recommended value determination unit 611 determines the recommended value of the minimum bet amount for each gaming table 4 in each area in accordance with the table congestion degree determined by the congestion degree determination unit 612 so that the high betting player can be played in the small number of gaming table 4.

As described above, in the present example, the recommended value determination unit 611 manages the plurality of gaming tables 4, determines the total bet amount of each player for each game and/or each predetermined time or period for each of the plurality of gaming tables 4, and determine different recommended values of the minimum bet amount for each of the plurality of gaming tables 4.

(Opening/Closing of Gaming table based on Area Congestion Degree)

The congestion degree determination unit 612 calculates the area congestion degrees of each area when the casino facility is divided into a plurality of areas, on the basis of the information on the number of players determined by the control device 14 as the player number determination device. The area congestion degree is a ratio of a total number of players to a total number of player positions in the area. A table opening/closing determination unit 613 may set as the area congestion degree the ratio of the gaming table 4 in which the table congestion degree exceeds a predetermined value (for example, 80%) in each area.

The table opening/closing determination unit 613 determines all gaming tables 4 in the casino facility and the number of opened gaming tables 4 among all the gaming tables and determines a recommended number of the gaming table 4 to be opened in each area according to the area congestion degree determined by the congestion degree determination unit 612. Specifically, if the area congestion degree becomes equal to or greater than a predetermined value (80% in the present embodiment), the table opening/closing determination unit 613 determines to newly open the gaming table 4 in the area.

When opening the new gaming table 4, the recommended value determination unit 611 determines the recommended value of the minimum bet amount of the gaming table 4. The recommended value determination unit 611 may simply set the same minimum bet amount as the minimum bet amount of the gaming table 4 around the newly opened gaming table 4 in the newly opened gaming table 4. By doing so, a customer can be guided to the area to be played efficiently.

Figure 18A:
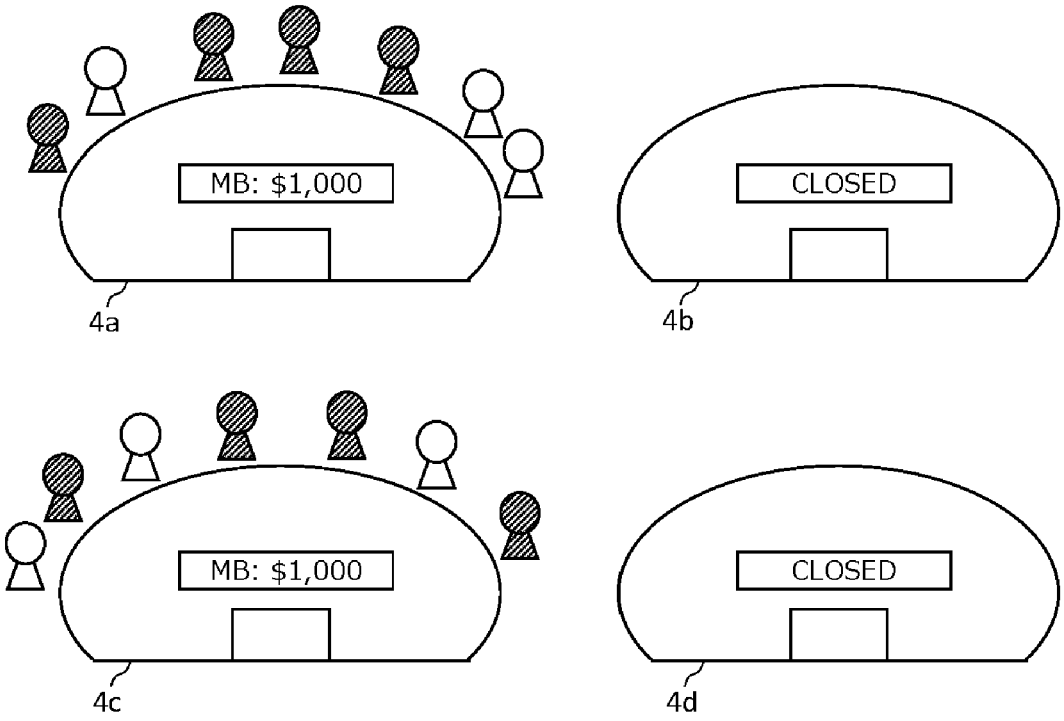
FIG. 18A is a diagram for describing an example of opening a new gaming table in a certain area.
Figure 18B:
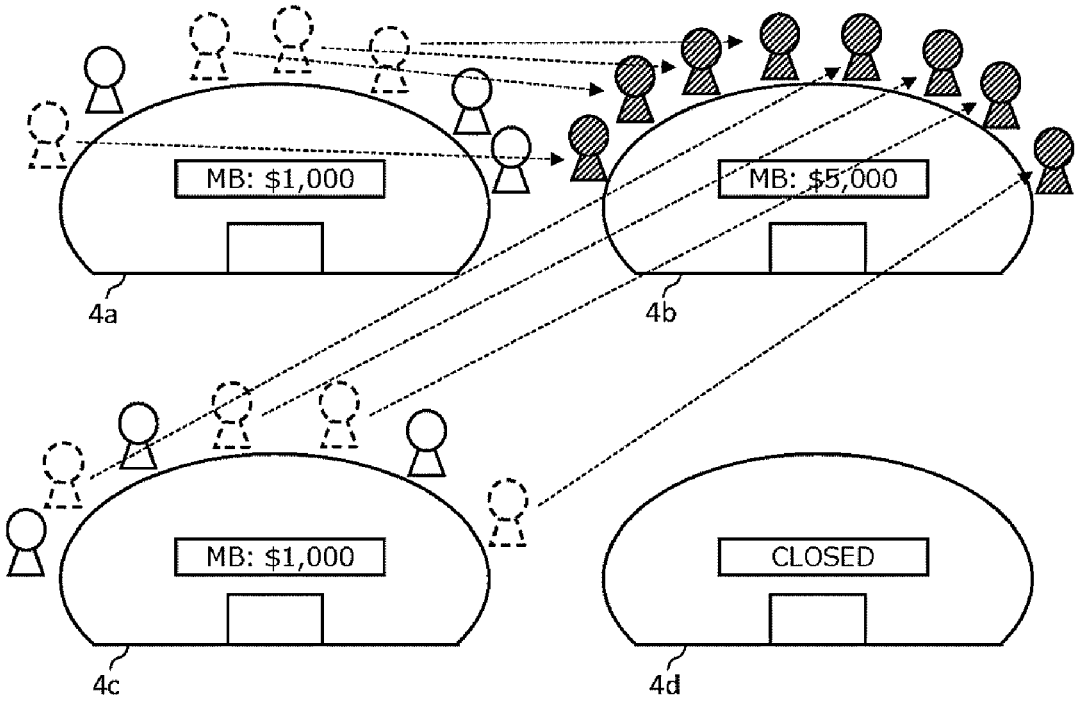
FIG. 18B is a diagram for describing an example of opening a new gaming table in a certain area.
Figure 18C:
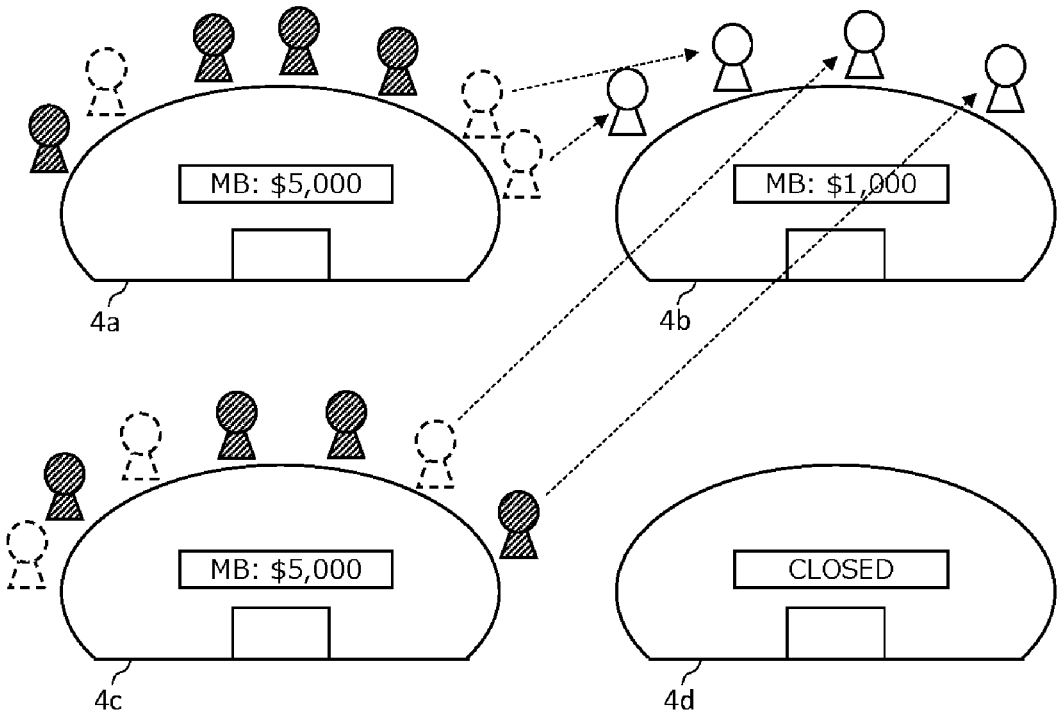
FIG. 18C is a diagram for describing an example of opening a new gaming table in a certain area.
Figure 19:
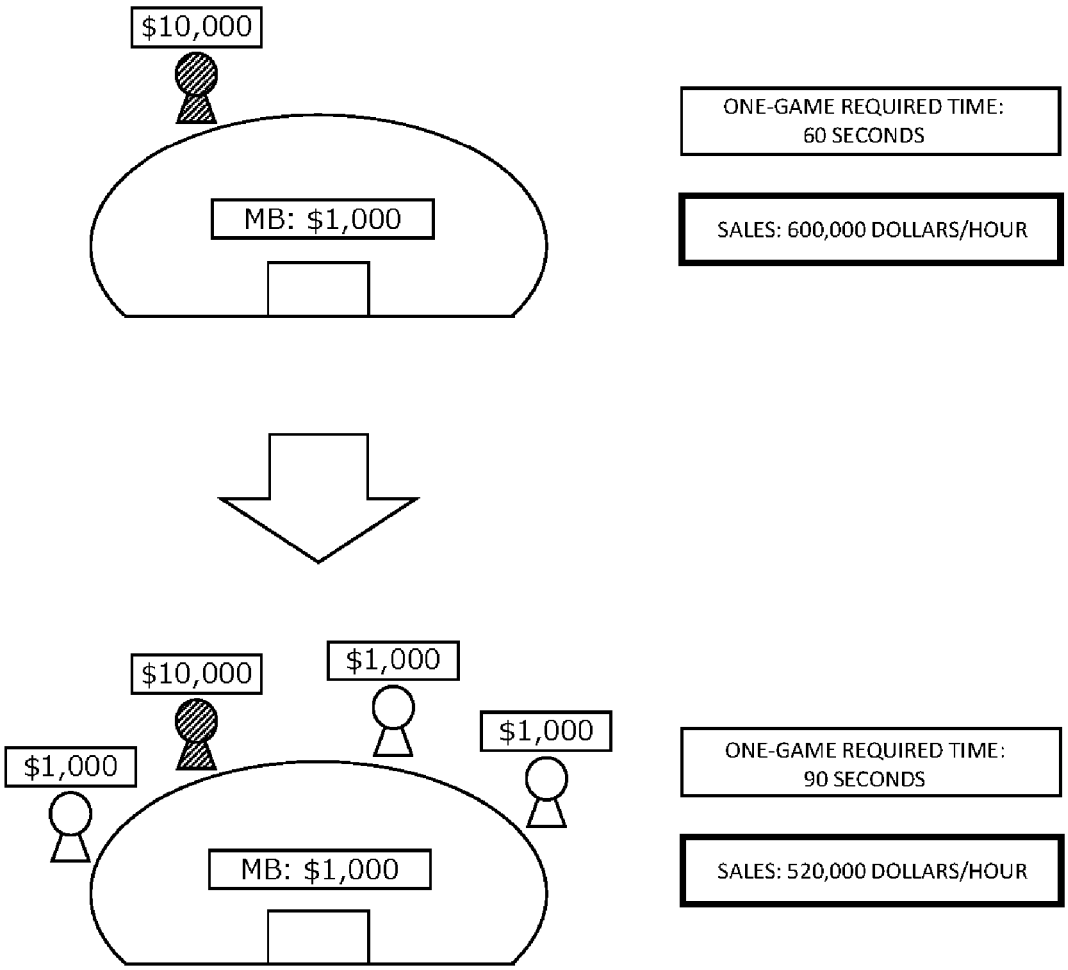
FIG. 19 is a diagram for describing a situation in which the sales of the entire casino facility are kept low.

On the other hand, when newly opening the gaming table 4, the recommended value determination unit 611 may determine the recommended value of the minimum bet amount so that the sales of the casino operator are maximized. FIGS. 18A to 18C are diagrams for describing an example of opening a new gaming table 4 in a certain area. Again, the average required time of one game when the player is playing alone is 60 seconds, and the average required time of one game increases by 10 seconds each time the player increases by one. In addition, the average bet amount of the high betting player (hatched player in the figure) is set to 5,000 dollars, and the average bet amount of the low betting player (player painted in white in the drawing) is set to 1,000 dollars.

In the case of FIG. 18A, the gaming tables 4*a* and 4*c* are opened and seven players are participating in a game for eight people, in which four of the seven players are high betting players and three players are low betting players. FIG. 18B shows the case in which in the situation of FIG. 18A, the gaming table 4*b* is newly opened and the minimum bet amount is set to 5,000 dollars. It is considered that as shown in FIG. 18B, all the high betting players playing on the gaming tables 4*a* and 4*c* move to the gaming table 4*b* by setting the minimum bet amount of the newly opened gaming table 4*b* to 5,000 dollars.

In the case of FIG. 18B, the average sales of 1,380,000 dollars per hour in the situation of FIG. 18A decrease to 1,377,000 dollars per hour. In this way, when the gaming table 4 is newly opened, depending on the setting of the minimum bet amount, sales may not increase greatly or decrease in some cases. In addition, considering the cost incurred due to the opening of the new gaming table 4, the profit of the casino operator decreases.

In the case of FIG. 18A, as shown in FIG. 18C, it is effective to set the low minimum bet amount for the newly opened gaming table 4*b* and at the same time, increase the minimum bet amount for the already opened gaming tables 4*a* and 4*c*. By doing so, in the situation of FIG. 18A, the average sales of 1,380,000 dollars per hour increase to 1,760,000 per hour.

In this way, the recommended value determination unit 611 determines the minimum bet amount of the newly opened gaming table 4 on the basis of the minimum bet amount and the actual bet amount of the gaming table 4 around the gaming table 4. In addition, as in the example of FIG. 18C, the recommended value determination unit 611 changes the minimum bet amount of the gaming table 4 therearound at the timing of newly opening the gaming table 4, thereby urging the player to move from the gaming table 4 therearound to the newly opened gaming table.

The dealer management unit 614 manages a dealer who is at work, and the table opening/closing determination unit 613 determines whether or not to open a new gaming table 4 depending on the number of dealers. Specifically, even in the case in which the area congestion degree becomes high, when there are no waiting (available) dealers (that is, when all dealers are on the gaming table 4) and when there is no gaming table 4 which can be newly opened (that is, when all the gaming tables 4 are opened), the table opening/closing determination unit 613 does not determine to open a new gaming table 4 and the recommended value determination unit 611 copes with the change in the minimum bet amount of the already opened gaming table 4.

The congestion degree determination unit 612 can record the transition of the area congestion degree in each area, and the table opening/closing determination unit 613 may determine the recommended number of the gaming table 4 to be opened in each area on the basis of the information on the transition recorded by the congestion degree determination unit 612. That is, when the area congestion degree is increasing, the table opening/closing determination unit 613 determines to open a new gaming table 4 before the area congestion degree reaches a predetermined value in the area.

As described above, in the present example, the recommended value determination unit 611 manages the plurality of gaming tables 4, determines the total bet amount of each player for each game and/or each predetermined time or period for each of the plurality of gaming tables 4, and determine the recommended value of the minimum bet amount for the newly opened gaming table.

(Recommendation of Minimum Bet Amount based on Identification of Player)

The player management unit 615 has a function as a player identification unit which identifies the player participating in the game on the gaming table. Specifically, the player management unit 615 analyzes the image at the player position sent from the control device 14 of each gaming table 4 to identify players at each player position. For this purpose, the player registers a his/her face image in advance in the management control device 60. The player management unit 615 identifies the player by comparing the image sent from the control device 14 with the face image registered in advance.

The player management unit 615 may identify a player with a storage medium (for example, a membership card, a point card, or the like) possessed by the player in addition to or in place of identifying the player on the basis of the face image. An ID for identifying a player is stored in this storage medium. If a player arrives at the gaming table 4, the player hands the storage medium to the dealer, and the dealer reads the ID by a predetermined reading device. The control device 14 transmits the ID read from the storage medium to the management control device 60. The player management unit 615 can identify the player by receiving this ID.

Alternatively, the player management unit 615 may identify a player on the basis of biological information on the player playing on the gaming table 4. In this case, for example, a fingerprint recognition device is installed at each player position on the gaming table, and if a player arrives at the play position, fingerprint authentication is performed.

The control device 14 transmits the information on play contents (including a bet amount, a winning amount, and a lost amount) at each player position to the management control device 60. The player management unit 615 records information on the play contents in a recording apparatus 62 as a database which stores the information on the play contents associated with the ID of the player who is identified at the player position. In this way, the player management unit 615 records the past play contents at each player in the recording apparatus 62.

The player management unit 615 further calculates an average bet amount, an average continuous play time in the same table, an absence rate when the minimum bet amount increases, a recent winning percentage, a winning amount, and the like from the past play contents at each player, and stores the calculated information as tendency information on each player in the recording apparatus 62 as the database by associating the tendency information with the ID of the player.

For each area, the table opening/closing determination unit 613 may determine the recommended number of gaming tables to be newly opened on the basis of tendency information on a plurality of players in the area stored in the recording apparatus 62. In addition, for each area, the recommended value determination unit 611 determines the recommended value of the minimum bet amount of the currently opened gaming table 4 or the recommended value of the minimum bet amount of the newly opened gaming table 4 on the basis of the tendency information on the plurality of players in the area stored in the recording apparatus 62.

That is, in the above description, it is assumed from the state of FIG. 18A that all the high betting players move to the gaming table 4*b* when a new gaming table 4*b* having a relatively high minimum bet amount is opened as shown in FIG. 18B, but actually, there is a possibility that the player does not move as shown in FIG. 18B. Also, in FIG. 18C, it is assumed that all the low betting players will leave their seats when the minimum bet amount increases in the gaming tables 4*a* and 4*c*, but the low betting player increases the bet amount corresponding to the increased minimum bet amount and remains in the same gaming tables 4*a* and 4*c*. Therefore, the recommended value determination unit 611 performs a simulation using the probability on the basis of the tendency of each player stored in the recording apparatus 62, and determines the recommended value of the minimum bet amount so as to maximize sales.

In the second embodiment described above, as the gaming table 4, a table for playing a card game such as a baccarat is assumed and described, but the game performed on the gaming table 4 is not limited to the card game, and the game management system 101 of the second embodiment to all games can be applied to all games obtained by setting the minimum bet amount.

In addition, in the second embodiment, in order to determine the number of players, the image of the player photographed by the camera 2 is analyzed, but the unit which determines the number of players is not limited thereto. For example, the number of players can be understood even by a gaming token to be bet. That is, since a betting position is defined at each player position in a bet area and it is known to which position a player is betting, it is possible to know how many players are participating in a game. In other words, the unit which specifies the bet amount at each player position may also serve as a unit which determines the number of players.

In addition, in the second embodiment, when the minimum bet amount of the gaming table 4 increases, the minimum bet amount may increase up to the lowest bet amount of the player on the gaming table 4. For example, when there are players playing at 1,000 dollars and players playing at 5,000 dollars on a table with a minimum bet amount of 500 dollars, the minimum bet amount may increase up to 1,000 dollars.

Further, in the second embodiment, the recommended value of the minimum bet amount may be determined from the past statistics (in general, the case in which the bet amount increases in the evening, or the like). For example, in the case where it is determined from the past statistics that there is the tendency that the bet amount increases in the evening, the bet amount may increase at a predetermined timing in the evening.

Further, in the second embodiment, the management control device 60 may manage a plurality of gaming tables, determine information on at least one item of the number of players, the bet amount, or the concentration or distribution of the number of players, and determine the recommended value of the minimum bet amount for each gaming table 4 on the basis of the information.

What is claimed:

1. A game management system for managing casino games played on a plurality of gaming tables of a casino facility, comprising:

a set of processors including:

a gaming table processor for each gaming table of the plurality of gaming tables, and a central processor;

for each gaming table of the plurality of gaming tables at which a minimum bet amount of a game at the gaming table is set:

at least one sensor associated with the gaming table and configured to generate sensor output data associated with the game at the gaming table, the sensor output data indicative of:

positions, types, and numbers of bet gaming tokens associated with each player or each player position of a plurality of player positions of the gaming table, and a number of players participating in the game at the gaming table or a number of player positions at which the players participate in the game at the gaming table; and the game table processor associated with the gaming table, the gaming table processor configured to:

receive the sensor output data of the at least one sensor associated with the gaming table; and transmit a reporting result based on the sensor output data, the reporting result indicates a bet amount for each player or each player position of the gaming table and a number of players participating in the game at the gaming table or a number of player positions at which the players participate in the game at the gaming table; and an output device configured to output the minimum bet amount of the game at the gaming table; and wherein the central processor is communicatively coupled to each game table processor and configured to:

receive, from each game table processor, the reporting results output by the game table processor; and transmit, to the output device of a first gaming table of the plurality of gaming tables, output data associated with a recommended value of a minimum bet amount for a game at the first gaming table, the recommended value based on the indicated bet amounts for each player or each player position of the received reporting results and the indicated number of players or the indicated number of player positions of each of the received reporting results; and wherein the output device of the first gaming table is configured to display, based on the output data, an indication of the recommended value of the minimum bet amount for the game at the first gaming table; and wherein the set of processors is configured to:

determine, for a player of the players, or for a player position of the plurality of player positions, a transition of the bet amount of the player or the player position over a plurality of games; and determine the recommended value of the minimum bet amount based on the determined transition of the bet amount.

2. The game management system according to claim 1, wherein the set of processors is configured to determine, for each player of the players, or for each of the plurality of player positions of a gaming table of the plurality of gaming tables, transitions of the bet amount of the player or the player position over a plurality of games.

3. The game management system according to claim 1, wherein the set of processors is configured to:

determine or obtain respective results of the plurality of games: and determine, for a player, or for a player position of the player positions, a win or a loss, an income, and an expenditure of the player or the player position based on the bet amount for the player position and the results of the plurality of games.

4. The game management system according to claim 1, wherein the set of processors is configured to:

determine a congestion degree of each of a plurality of areas within the casino facility based on the indicated number of players participating in the game at the gaming table or the number of player positions at which the players participate in the game at the gaming table; and for each area of the plurality of areas, determine the recommended value of the minimum bet amount for one or more gaming tables of the area based on one or more of the determined degrees of congestion for the plurality of areas.

5. The game management system according to claim 4, wherein the set of processors is configured to determine, for the first gaming table, the recommended value of the minimum bet amount divided into a plurality of stages based on (a) the indicated number of players participating in the game at the gaming table or the number of player positions at which the players participate in the game at the gaming table, and (b) for each player or each of the player positions, (i) a respective lowest amount of the bet amounts identified for the respective player or player position or (ii) a respective average of the bet amounts identified for the respective player or player position.

6. The game management system according to claim 4, wherein the set of processors is configured to determine a number of the gaming tables that are opened in the casino facility, and determine, based on the determined degrees of congestion or the plurality of areas, a respective recommended number of gaming tables to be opened in each area of the plurality of areas.

7. The game management system according to claim 4, wherein the set of processors is configured to, for each area of the plurality of areas:

record a transition of the congestion degree, and determine a respective recommended number of gaming tables to be opened in the area based on the recorded transition of the congestion degree of the area.

8. The game management system according to claim 4, wherein the set of processors is configured to:

for each gaming table of the plurality of gaming tables:

identify the players;

associate each of the players with respective ones of the bet amounts identified at the player positions; and store the associated data in a database; and determine a recommended number of gaming tables to be opened in each area of the plurality of areas based on past bet tendency of each of the players as indicated by the associated data.

9. The game management system according to claim 1, wherein the set of processors is configured to increase the recommended value of the minimum bet amount of the first gaming table when at least a threshold percentage of the players or the player positions of the first gaming table bet an amount greater than or equal to a predetermined ratio with respect to the minimum bet amount previously set for the first gaming table.

10. The game management system according to claim 1, wherein the set of processors is configured to determine a minimum bet amount of a newly opened gaming table based on a minimum bet amount for a gaming table that is in a vicinity of the newly opened gaming table.

11. The game management system according to claim 1, wherein the set of processors is configured to determine a minimum bet amount of a newly opened gaming table based on the indicated respective bet amounts, which are identified for a gaming table that is in a vicinity of the newly opened gaming table.

12. The game management system according to claim 1, wherein the set of processors is configured to manage a number of dealers and determine whether to newly open a gaming table based on the number of dealers under management.

13. The game management system according to claim 1, wherein the set of processors is configured to change the minimum bet amount for the first gaming table, which is in a vicinity of a newly opening gaming table, based on the opening of the newly opening gaming table.

14. The game management system according to claim 1, wherein the set of processors is configured to determine the recommended value of the minimum bet amount respectively for each of the plurality of gaming tables in a manner that increases a ratio of profit to sales.

15. The game management system according to claim 1, wherein the set of processors is configured to determine the recommended value of the minimum bet amount respectively for each of the plurality of gaming tables in a manner that increases a number of games per unit time or an average value of total bet amounts per game.

16. The game management system according to claim 1, wherein the set of processors is configured to:

determine a respective total bet amount of all of the players or the player positions respectively for each of one or both of (a) a plurality of games of the plurality of gaming tables and (b) predetermined times or periods associated with respective ones of the plurality of gaming tables; and for each of the plurality of gaming tables, determine a recommended value of the minimum bet amount of the gaming table.

17. The game management system according to claim 1, wherein the set of processors is configured to:

determine a respective total bet amount of all of the players or the player positions respectively for both of (a) a plurality of games of the plurality of gaming tables and (b) respective predetermined times or periods associated with respective ones of the plurality of gaming tables; and for each of the plurality of gaming tables, determine a recommended value of the minimum bet amount of the gaming table.

18. The game management system according to claim 1, wherein the set of processors is configured to:

determine a respective total bet amount of all of the players or the player positions respectively for each of one or both of (a) the plurality of games of the plurality of gaming tables and (b) respective predetermined times or periods associated with respective ones of the gaming tables; and determine a recommended value of the minimum bet amount for a newly opened gaming table.

19. The game management system according to claim 1, wherein the set of processors is configured to:

determine information regarding at least one of a number of the players participating in the game at the gaming table or a number of player positions at which the players participate in the game at the gaming table, the bet amounts, and a concentration or dispersion of the number of players or the number of player positions relative to a number of the plurality of gaming tables; and for each of the gaming tables, determine a recommended value of the minimum bet amount for the gaming table based on the information.

20. The game management system according to claim 1, wherein the output device is configured to display the indication of the recommended value of the minimum bet amount for the game at the gaming table such that the game at the first gaming table is played using the recommended value as the minimum bet amount.

21. The game management system according to claim 1, Wherein the at least one sensor includes:

a radio-frequency identification (RFID) reader configured to read RFID information associated with an RFID tag included in one or more gaming tokens; or a camera configure to capture an image associated with the positions, types, and numbers of bet gaming tokens.

22. The game management system according to claim 21, wherein the gaming table processor is configured to process the RFID information or perform image processing on the image to identify the bet amount for each player or each player position of the gaming table and the number of players participating in the game at the gaming table or the number of player positions at which the players participate in the game at the gaming table.

23. The game management system according to claim 1, wherein the central processor is configured to determine the recommended value based on the bet amounts for each player or each player position indicated by the received reporting results and the number of players or the number of the player positions indicated by the received reporting results.

24. The game management system according to claim 1, wherein display of the indication of the recommended value by the output device of the first gaming table automatically sets or updates the minimum bet amount for the first gaming table as the recommended value.

25. The game management system according to claim 1, wherein the output device is configured to output the indication based on an input received from a dealer and associated with an indication to set the minimum bet amount for the first gaming table to the recommended value.

26. The game management system according to claim 1, further comprising a memory configured to store, for each gaming table of the plurality of gaming tables, a value of the minimum bet set for the game at the gaming table.

27. A game management system for managing a casino games played on a gaming table of a casino facility, comprising:

an output device associated with the gaming table having a minimum bet amount that is set;

at least one sensor configured to generate sensor output data associated with a game at the gaming table, the sensor output data indicative of:

positions, types, and numbers of bet gaming tokens associated with a bet amount of each player or each player position of a plurality of player positions of the gaming table, and a number of players participating in the game at the gaming table or a number of player positions at which the players participate in the game at the gaming table; and at least one processor coupled to the at least one sensor and configured to receive the sensor output data from the at least one sensor;

determine, for a player of the players, or a player position of the plurality of player positions, a transition of the bet amount of the player or the player position over a plurality of games;

determine a recommended value of the minimum bet amount based on the determined transition of the bet amount and based on historical data including bet amounts identified in the past and numbers of players or number of player positions determined in the past; and transmit output data associated with the recommended value of the minimum bet amount for a game at the gaming table; and wherein the output device is configured to display, based on the output data, an indication of the recommended value of the minimum bet amount for the game at the gaming table.

28. The game management system according to claim 27, further comprising:

a memory configured to store historical data including bet amounts identified in the past and numbers of players or number of player positions determined in the past; and wherein the at least one processor is further configured to access the historical data from the memory.

29. The game management system according to claim 27, wherein the output device is configured to display the indication of the recommended values such that the game at the gaming table is played using the recommended value as the minimum bet amount.

30. The game management system according to claim 27, wherein display of the indication of the recommended value of the minimum bet amount automatically sets or updates the minimum bet amount for the gaming table as the recommended value.

31. A game management system for managing casino games played on a plurality of gaming tables of a casino facility, comprising:

a set of processors including:

a gaming table processor for each gaming table of the plurality of gaming tables, and a central processor;

for each gaming table of the plurality of gaming tables at which a minimum bet amount of a game at the gaming table is set:

at least one sensor associated with the gaming table and configured to generate sensor output data associated with the game at the gaming table, the sensor output data indicative of:

positions, types, and numbers of bet gaming tokens associated with each player or each player position position of a plurality of player positions of the gaming table, and a number of players participating in the game at the gaming table or a number of player positions at which the players participate in the game at the gaming table; and the game table processor associated with the gaming table, the gaming table processor configured to:

receive the sensor output data of the at least one sensor associated with the gaming table; and transmit a reporting result based on the sensor output data, the reporting result indicates a bet amount for each player or each player position of the gaming table and a number of players participating in the game at the gaming table or a number of player positions at which the players participate in the game at the gaming table; and an output device configured to output the minimum bet amount of the game at the gaming table; and wherein the central processor is communicatively coupled to each game table processor and configured to:

receive, from each game table processor, the reporting results output by the game table processor; and transmit, to the output device of a first gaming table of the plurality of gaming tables, output data associated with a recommended value of a minimum bet amount for a game at the first gaming table, the recommended value based on the indicated bet amounts for each player or each player position of the received reporting results and the indicated number of players or the indicated number of player positions of each of the received reporting results; and wherein the output device of the first gaming table is configured to display, based on the output data, an indication of the recommended value of the minimum bet amount for the game at the first gaming table; and wherein the set of processors is configured to increase the recommended value of the minimum bet amount of the first gaming table when at least a threshold percentage of the players or the player positions of the first gaming table bet an amount greater than or equal to a predetermined ratio with respect to the minimum bet amount previously set for the first gaming table.

* * * * *